US011170687B2

(12) United States Patent
Heo et al.

(10) Patent No.: US 11,170,687 B2
(45) Date of Patent: Nov. 9, 2021

(54) DISPLAY DRIVING CIRCUIT, OPERATION METHOD THEREOF, AND OPERATION METHOD OF OPTICAL-BASED MURA INSPECTION DEVICE CONFIGURED TO EXTRACT INFORMATION FOR COMPENSATING MURA OF DISPLAY PANEL

(71) Applicant: SAMSUNG ELECTRONICS CO., LTD., Suwon-si (KR)

(72) Inventors: Pil-Seung Heo, Seoul (KR); Sang-Kyo Han, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/031,209

(22) Filed: Sep. 24, 2020

(65) Prior Publication Data

US 2021/0264833 A1 Aug. 26, 2021

(30) Foreign Application Priority Data

Feb. 26, 2020 (KR) ..... 10-2020-0023408

(51) Int. Cl.
*G09G 3/20* (2006.01)

(52) U.S. Cl.
CPC ..... *G09G 3/20* (2013.01); *G09G 2310/027* (2013.01); *G09G 2320/0276* (2013.01); *G09G 2320/04* (2013.01)

(58) Field of Classification Search
CPC ... G09G 2320/0285; G09G 2320/0626; G09G 3/20; G09G 2360/16
See application file for complete search history.

(56) References Cited

U.S. PATENT DOCUMENTS

| | | | | |
|---|---|---|---|---|
| 9,761,184 | B2 | 9/2017 | Kim et al. | |
| 9,881,568 | B2 | 1/2018 | Na et al. | |
| 9,959,804 | B1 | 5/2018 | Kuang et al. | |
| 10,170,063 | B2 | 1/2019 | Zhang | |
| 10,276,111 | B2 | 4/2019 | Zhang | |
| 10,283,071 | B2 | 5/2019 | Liu et al. | |
| 2013/0321479 | A1* | 12/2013 | Ka | G09G 3/3241 345/690 |
| 2016/0163274 | A1 | 6/2016 | Moon et al. | |
| 2016/0275869 | A1* | 9/2016 | Hwang | G09G 3/3258 |
| 2018/0144719 | A1* | 5/2018 | Lee | G09G 3/006 |
| 2018/0322834 | A1* | 11/2018 | Zhang | G09G 3/2007 |
| 2020/0320944 | A1* | 10/2020 | Zhang | G09G 3/3648 |
| 2021/0082357 | A1* | 3/2021 | Xiao | G02F 1/133603 |

* cited by examiner

*Primary Examiner* — Gerald Johnson
(74) *Attorney, Agent, or Firm* — Volentine, Whitt & Francos, PLLC

(57) ABSTRACT

An operation method of a display driving circuit configured to drive a display panel includes receiving input data from an external device, determining a gray level period corresponding to the input data from among a plurality of gray level periods, based on a plurality of thresholds, calculating a final compensation value based on the determined gray level period and a reference look-up table generated based on a reference gray level, performing MURA compensation on the input data based on the final compensation value to generate final data, and controlling the display panel based on the final data.

20 Claims, 28 Drawing Sheets

DISPLAY DRIVING CIRCUIT, OPERATION METHOD THEREOF, AND OPERATION METHOD OF OPTICAL-BASED MURA INSPECTION DEVICE CONFIGURED TO EXTRACT INFORMATION FOR COMPENSATING MURA OF DISPLAY PANEL

CROSS-REFERENCE TO RELATED APPLICATIONS

This application claims priority under 35 U.S.C. § 119 to Korean Patent Application No. 10-2020-0023408 filed on Feb. 26, 2020, in the Korean Intellectual Property Office, the disclosure of which is incorporated by reference herein in its entirety.

BACKGROUND

Embodiments of the disclosure described herein relate to a display device, and more particularly, relate to a display driving circuit, an operation method of the display driving circuit, and an operation method of an optical-based MURA inspection device configured to extract information for compensating a MURA of a display panel.

A display device is a device configured to convert a variety of information in a visual form so as to be provided to a user. In general, the display device includes a plurality of pixels configured to express a variety of information depending on an electrical signal. In an ideal display panel, the plurality of pixels are configured to express the same luminance when the same signal is provided to the plurality of pixels. However, a plurality of pixels of an actual display panel may fail to express the same luminance in response to the same signals due to various different environmental factors or a manufacturing process. This luminance imbalance may appear in a stain shape (called a "MURA") in the display panel.

SUMMARY

Embodiments of the disclosure provide a display driving circuit configured to provide an image of improved quality by removing a MURA of a display panel, an operation method of the display driving circuit, and an operation method of an optical-based MURA inspection device configured to extract information for compensating the MURA of the display panel.

According to an exemplary embodiment, an operation method of a display driving circuit configured to drive a display panel includes receiving input data from an external device, determining a gray level period corresponding to the input data from among a plurality of gray level periods, based on a plurality of thresholds, calculating a final compensation value based on the determined gray level period and a reference look-up table generated based on a reference gray level, performing MURA compensation on the input data based on the final compensation value to generate final data, and controlling the display panel based on the final data.

According to an exemplary embodiment, a display driving circuit configured to drive a display panel includes a storage circuit that stores a plurality of thresholds and a reference look-up table generated based on a reference gray level, a MURA compensation circuit that receives input data from an external device, decides a gray level period corresponding to the input data from among a plurality of gray level periods, based on the plurality of thresholds, calculates a final compensation value based on the decided gray level period and the reference look-up table, and performs MURA compensation on the input data based on the calculated final compensation value to generate final data. A source driver drives a plurality of source lines connected with the display panel, and a timing controller controls the source driver based on the final data.

According to an exemplary embodiment, an operation method of an optical-based MURA inspection device configured to extract information to be used to compensate a MURA of a display panel includes measuring reference optical information from the display panel, which is controlled based on a reference gray level; generating a reference look-up table based on the reference optical information; storing the reference look-up table in a display driving circuit configured to control the display panel; generating a gray level pattern based on a plurality of gray levels expressible by the display panel; measuring supplementary optical information from the display panel controlled based on the gray level pattern; deciding a plurality of thresholds for determining a plurality of gray level periods based on the gray level pattern and the supplementary optical information; and storing the plurality of thresholds in the display driving circuit.

According to an exemplary embodiment, an operation method of a display driving circuit configured to drive a display panel includes generating first compensation data by performing first MURA compensation on input data from an external device by using a reference look-up table generated based on a reference gray level; determining a gray level period corresponding to the input data from among a plurality of gray level periods, based on a plurality of thresholds; calculating a supplementary compensation value based on the determined gray level period; performing second MURA compensation on the first compensation data based on the supplementary compensation value to generate final data; and controlling the display panel based on the final data.

BRIEF DESCRIPTION OF THE FIGURES

The above and other objects and features of the disclosure will become apparent by describing in detail exemplary embodiments thereof with reference to the accompanying drawings.

DETAILED DESCRIPTION

Below, embodiments of the disclosure may be described in detail and clearly to such an extent that an ordinary one in the art easily implements the disclosure.

Components described in the specification by using terms "part", "unit", "module", etc. and function blocks illustrated in drawings may be implemented with software, hardware, or a combination thereof. For example, the software may be a machine code, firmware, an embedded code, and application software. For example, the hardware may include an electrical circuit, an electronic circuit, a processor, a computer, an integrated circuit, integrated circuit cores, a pressure sensor, an inertial sensor, a microelectromechanical system (MEMS), a passive element, or a combination thereof.

Figure 1:
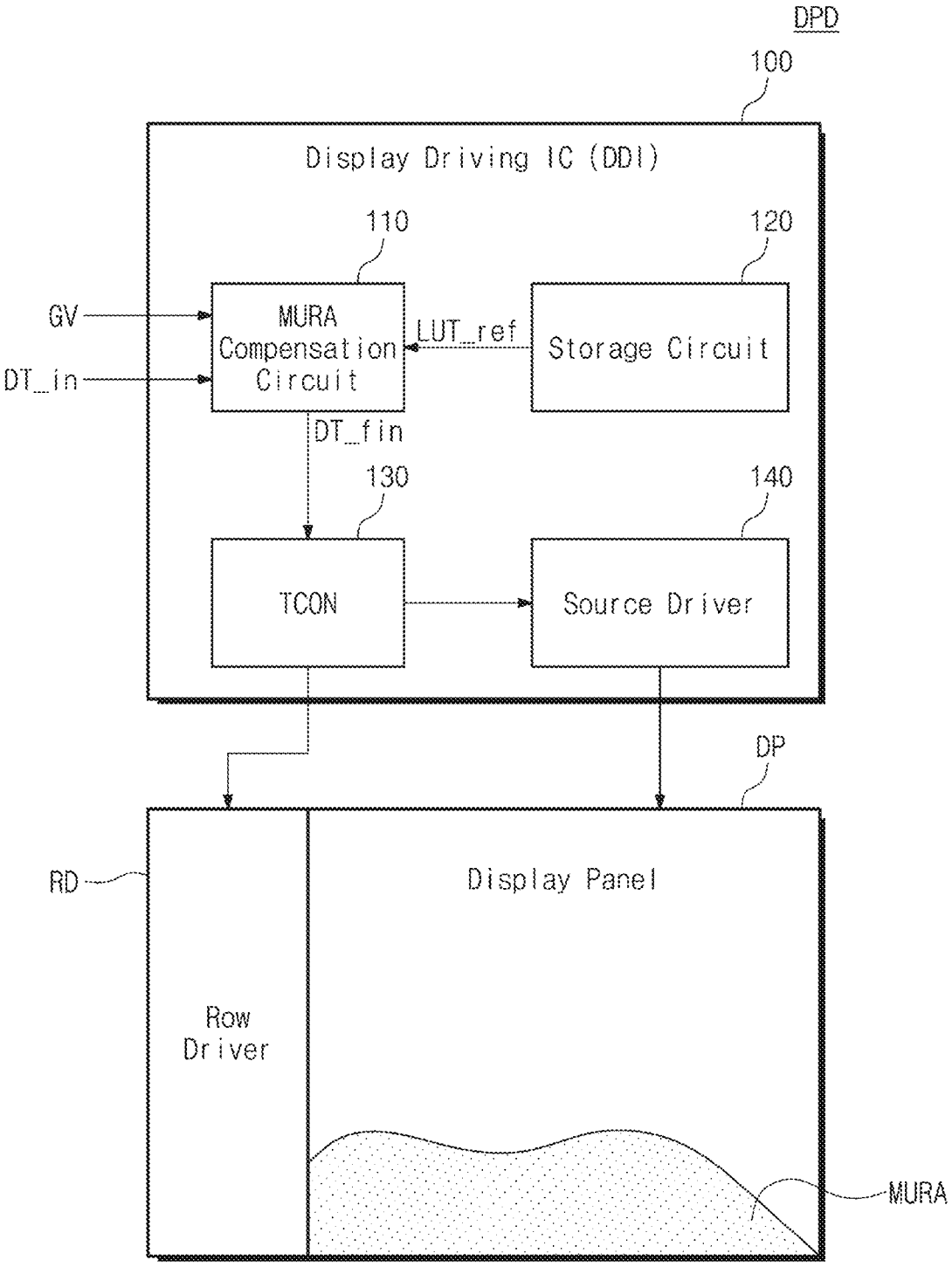
FIG. 1 is a block diagram illustrating a display device according to an embodiment of the disclosure.

FIG. 1 is a block diagram illustrating a display device according to an embodiment of the disclosure. Referring to FIG. 1, a display device DPD may include a display driving integrated circuit or a display driving circuit (DDI) 100 and a display panel DP. The display device DPD may be included in an electronic device configured to provide a variety of image information to a user, such as a monitor, a television (TV), a tablet PC, a smartphone, or a navigation device.

The display panel DP may be connected with a row driver RD through a plurality of gate lines and may be connected with the display driving circuit 100 through a plurality of data lines. The display panel DP may include a plurality of pixels connected with the plurality of gate lines and the plurality of data lines. The plurality of pixels may be divided into a plurality of groups based on colors to be displayed. Each of the plurality of pixels may display one of primary colors. The primary colors may include, but are not limited to, a red color, a green color, a blue color, and a white color. For example, the primary colors may further include various colors such as yellow, cyan, and magenta.

The display panel DP may include at least one of various types of panels such as a liquid crystal display panel, an organic light emitting display panel, an electrophoretic display panel, and an electrowetting display panel. However, the display panel DP according to the disclosure is not limited thereto. For example, the display panel DP according to the disclosure may be implemented with the above display panels or any other display panels. In an exemplary embodiment, the display panel DP including the liquid crystal display panel may further include a polarizer (not illustrated), a backlight unit (not illustrated), etc.

To output image information through the display panel DP, the display driving circuit 100 may control the row driver RD and may provide data signals through the plurality of data lines. In an exemplary embodiment, even though the display driving circuit 100 controls the display panel DP based on the same gray level, luminance displayed or expressed in the display panel DP may be irregular due to a process deviation, an optical characteristic, etc. of the display panel DP. This luminance irregularity or imbalance may cause a display stain (or called a "MURA").

The display driving circuit 100 may compensate the MURA occurring in the display panel DP. For example, the display driving circuit 100 may include a MURA compensation circuit 110, a storage circuit 120, a timing controller (TCON) 130, and a source driver 140.

The MURA compensation circuit 110 may perform a MURA compensation operation on input data DT_in received from an external device (e.g., an application processor (AP) or a graphic processing unit (GPU)), based on a reference look-up table LUT_ref stored in the storage circuit 120. In an exemplary embodiment, the reference look-up table LUT_ref may be decided based on optical information that is measured based on a reference gray level of a plurality of grays levels expressible in the display panel DP. The optical information may be measured by a separate optical-based MURA inspection device. In an exemplary embodiment, the reference look-up table LUT_ref may be called a "MURA map" or a "MURA look-up table". A configuration of the reference look-up table LUT_ref will be more fully described with reference to drawings below.

The MURA compensation circuit 110 may output final data DT_fin as a result of the MURA compensation operation. In an exemplary embodiment, the MURA compensation circuit 110 may use a gamma value GV set by the external device, in the above MURA compensation operation.

The timing controller 130 may receive the final data DT_fin from the MURA compensation circuit 110 and may control the source driver 140 based on the received final data DT_fin. The source driver 140 may control the plurality of data lines connected with the display panel DP, under control of the timing controller 130 or based on the data (e.g., DT_fin) provided from the timing controller 130.

As described above, the display driving circuit 100 according to an embodiment of the disclosure may include the MURA compensation circuit 110 configured to compensate the MURA occurring in the display panel DP. In an exemplary embodiment, the MURA compensation circuit 110 according to an embodiment of the disclosure may perform a first MURA compensation operation based on the reference look-up table LUT_ref and a second MURA compensation operation based on a supplementary compensation value decided according to a period of the input data DT_in. Alternatively, the MURA compensation circuit 110 according to an embodiment of the disclosure may perform the MURA compensation operation based on a compensation value re-processed or a re-calculated according to the period of the input data DT_in. An operation and a configuration of the MURA compensation circuit 110 according to an embodiment of the disclosure will be more fully described with reference to drawings below.

Figure 2A:
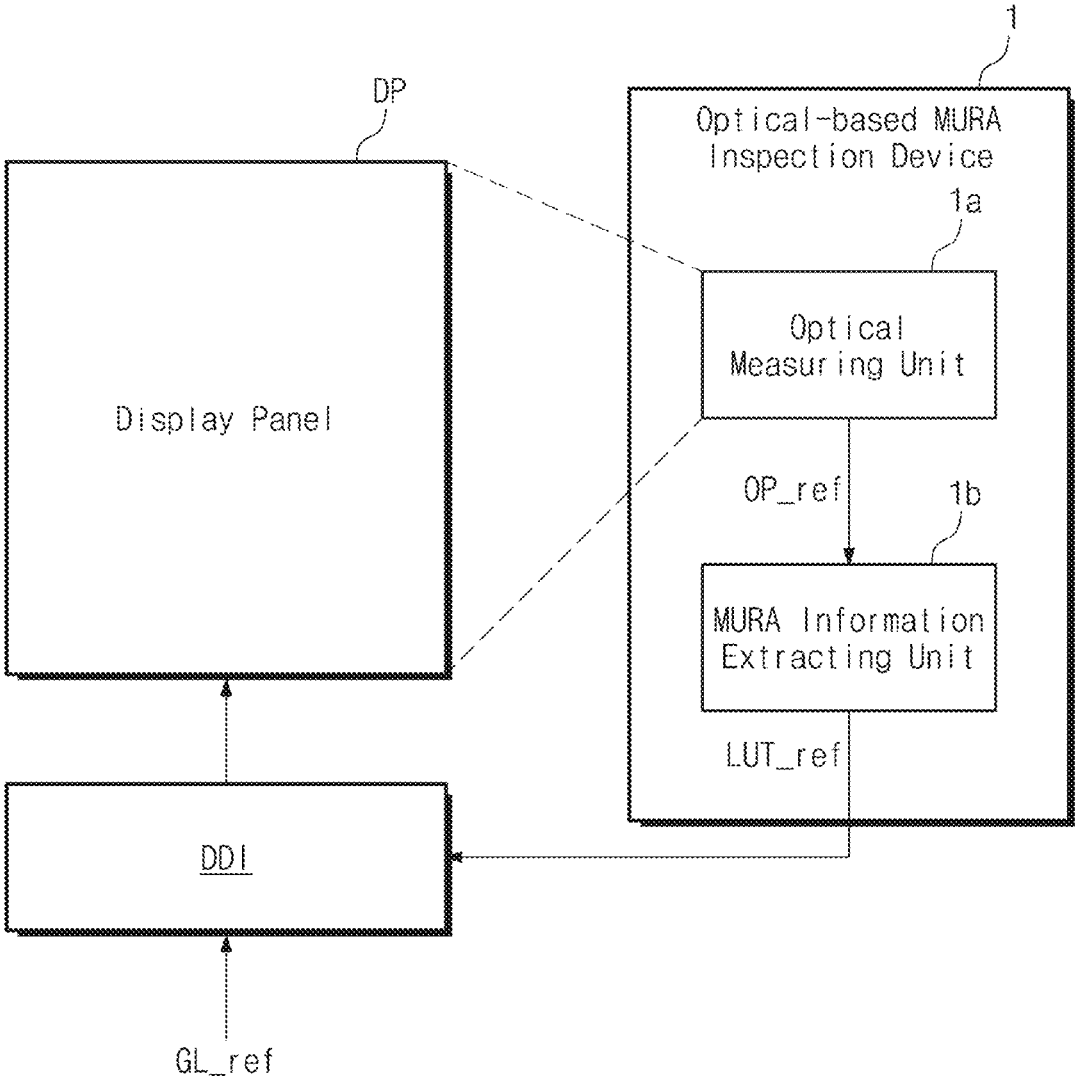
FIG. 2A (Related Art)
FIGS. 2A to 2C are diagrams for describing an operation of extracting a reference look-up table stored in a storage circuit of FIG. 1.
Figure 2B:
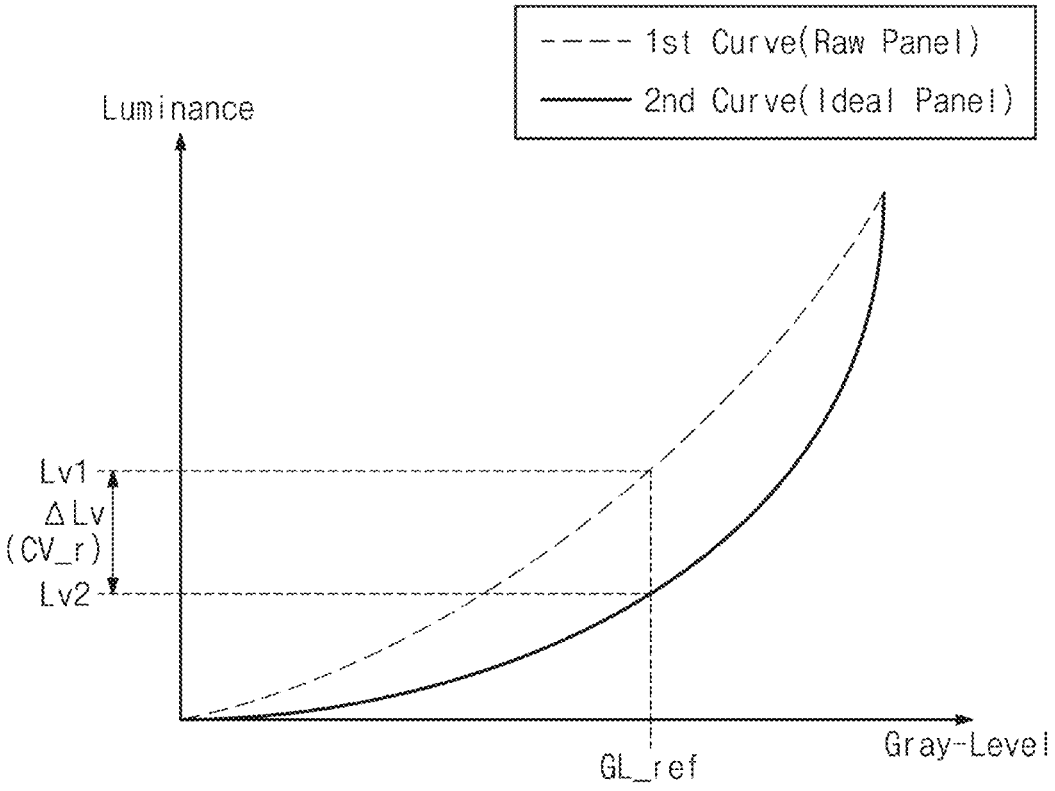
FIG. 2B (Related Art)
Figure 2C:
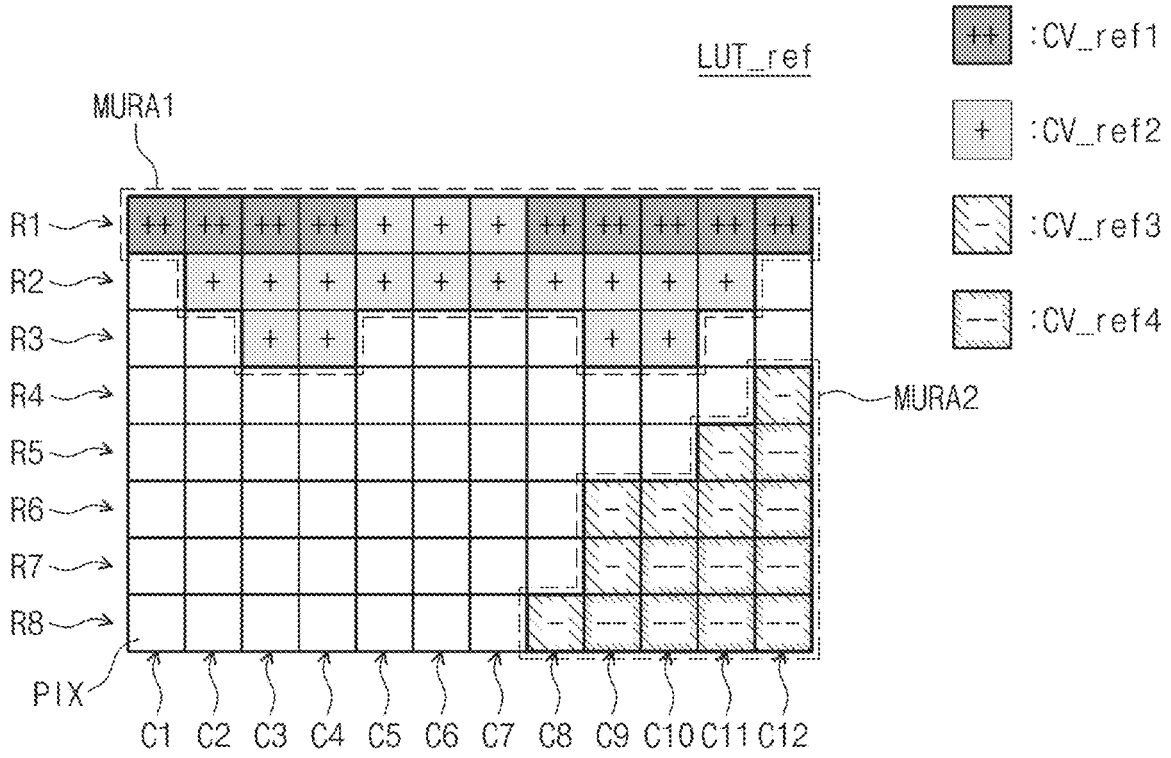
FIG. 2C (Related Art)

FIGS. 2A to 2C are diagrams for describing an operation of extracting a reference look-up table stored in a storage circuit of FIG. 1. FIG. 2A is a diagram illustrating an optical-based MURA inspection device configured to extract a reference look-up table. FIG. 2B is a graph illustrating a relationship between a gray level and luminance with regard to a specific pixel of a plurality of pixels included in a display panel. In FIG. 2B, a horizontal axis represents a gray level of input data provided to one pixel, and a vertical axis represents luminance expressed from one pixel. FIG. 2C is a diagram for describing a reference look-up table.

Below, for convenience of description, it is assumed that the reference look-up table LUT_ref includes a reference correction value CV_ref for each of the plurality of pixels. The above assumption is given as the reference correction value CV_ref corresponds to one pixel, but the disclosure is not limited thereto. For example, one reference correction value CV_ref may include correction values for a plurality of colors (e.g., "R", "G", and "B") corresponding to one pixel.

Also, for brevity of illustration and convenience of description, it is assumed that the gamma value GV provided from the external device is a preset value. That is, in embodiments illustrated below or to be described below, the gamma value GV may be a specific value, that is, a fixed value, but the disclosure is not limited thereto. For example, it may be understood that the gamma value GV is changed under control of the external device and a shape of a gray level-luminance curve is changed by the changed gamma value GV. The above examples are simple examples for describing the technical idea of the disclosure easily, and the disclosure is not limited thereto.

Referring to FIGS. 1 to 2C, an optical-based MURA inspection device 1 may extract the reference look-up table LUT_ref based on optical information (or image information) obtained or captured from the display panel DP. For example, the display driving circuit 100 may allow the display panel DP to express a reference gray level GL_ref. An optical measuring unit 1*a* included in the optical-based MURA inspection device 1 may measure or capture reference optical information OP_ref from the display panel DP. The reference optical information OP_ref may indicate an image associated with a front surface (i.e., one surface through which a screen is output) of the display panel DP controlled according to the reference gray level GL_ref. In this case, the display panel DP may be controlled to express the reference gray level GL_ref or the display panel DP may operate based on data corresponding to the reference gray level GL_ref.

A MURA information extracting unit 1*b* included in the optical-based MURA inspection device 1 may extract the reference look-up table LUT_ref based on the reference optical information OP_ref. For example, in FIG. 2B, a first curve indicates a gray level-luminance relationship associated with a specific pixel of a raw display panel to which compensation is not applied and a second curve indicates a gray level-luminance relationship associated with one pixel of an ideal display panel.

That is, with regard to the reference gray level GL_ref, a specific pixel of a plurality of pixels included in the display panel DP may express first luminance Lv1 like the first curve. However, with regard to the reference gray level GL_ref, a second luminance Lv2 may be expressed by the ideal display panel, like the second curve. That is, when data of the reference gray level GL_ref are provided to the display panel DP, luminance imbalance corresponding to a luminance difference ΔLv may occur at the specific pixel of the display panel DP. That is, when data of the reference gray level GL_ref are provided to the display panel DP, the MURA corresponding to the luminance difference ΔLv may occur at the specific pixel.

Accordingly, the MURA occurring at the specific pixel with regard to the reference gray level GL_ref may be removed or compensated by compensating luminance or input data as much as the luminance difference ΔLv. In an exemplary embodiment, the luminance difference ΔLv may correspond to the reference correction value CV_ref (CV_r in FIG. 2B) of the specific pixel.

With regard to the reference gray level GL_ref, the MURA information extracting unit 1*b* may detect a luminance difference for each of the plurality of pixels included in the display panel DP and may extract or generate the reference look-up table LUT_ref, as illustrated in FIG. 2C, based on the detected luminance difference for each pixel. For example, as illustrated in FIG. 2C, it is assumed that the display panel DP includes a plurality of pixels PIX arranged in an 8×12 matrix (e.g., eight rows R1-R8 and twelve columns C1-C12), but the disclosure is not limited thereto. In this case, the reference look-up table LUT_ref may include information of the reference correction value CV_ref for each of the plurality of pixels PIX. In an exemplary embodiment, the reference correction value CV_ref may be a value that corresponds to a luminance difference occurring at the corresponding pixel to which data of the reference gray level GL_ref are provided.

With regard to the reference gray level GL_ref, pixels at the first row R1 and the first to fourth and eighth to twelfth columns C1 to C4 and C8 to C12 may have a luminance difference with a reference luminance (e.g., Lv2 of FIG. 2B) that is a magnitude corresponding to a first reference compensation value CV_ref1. With regard to the reference gray level GL_ref, pixels at the first row R1 and the fifth to seventh columns C5 to C7, at the second row R2 and the second to eleventh columns C2 to C11, and the third row R3 and the third, fourth, ninth, and tenth columns C3, C4, C9, and C10 may have a luminance difference with the reference luminance that is a magnitude corresponding to a second reference compensation value CV_ref2. Likewise, with regard to the reference gray level GL_ref, some pixels of the plurality of pixels of the display panel DP may have a luminance difference with the reference luminance that is a magnitude corresponding to a third or fourth reference compensation value CV_ref3 or CV_ref4. The above luminance differences may appear as a first MURA MURA1 and a second MURA MURA2 on the display panel DP.

The MURA information extracting unit 1*b* may detect the luminance differences as described above and may extract the reference look-up table LUT_ref, as illustrated in FIG. 2C, based on the detected luminance differences.

In an exemplary embodiment, the plurality of reference correction values CV_ref of the reference look-up table LUT_ref may correspond to the plurality of pixels included in the display panel DP, respectively. In an exemplary embodiment, the plurality of pixels may be configured to express different colors (e.g., R, G, and B) in units of a group. That is, the plurality of reference correction values CV_ref may have values corresponding to a plurality of colors (e.g., R, G, and B).

In an exemplary embodiment, the plurality of pixels included in the display panel DP may be divided into given groups and the plurality of reference correction values CV_ref of the reference look-up table LUT_ref may correspond to the pixel groups, respectively. In this case, because the reference look-up table LUT_ref includes the reference correction values CV_ref corresponding to the pixel groups, a resource of the storage circuit 120 may decrease. In an exemplary embodiment, the reference correction values CV_ref of the pixel groups may be converted into compensation values of a pixel unit through a recovery calculation operation such as interpolation.

Figure 3A:
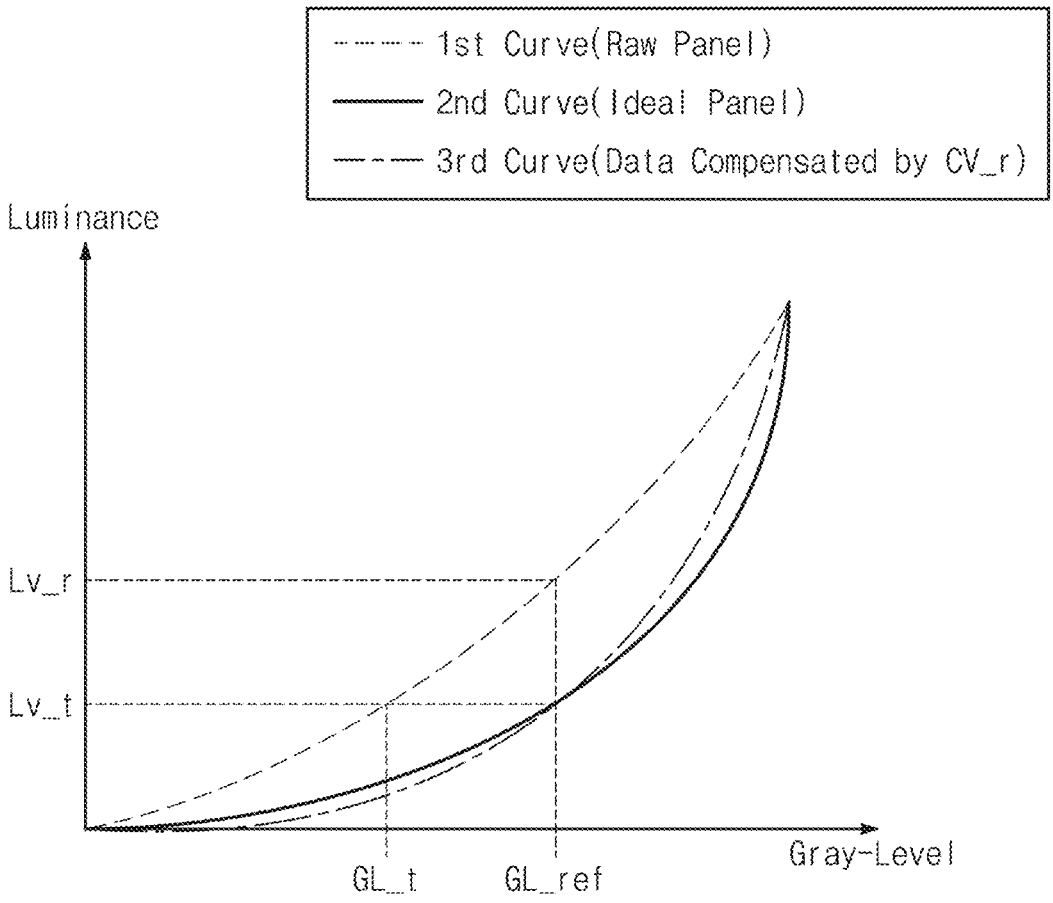
FIG. 3A (Related Art)
FIGS. 3A and 3B are graphs for describing a MURA compensation operation using a reference look-up table.
Figure 3B:
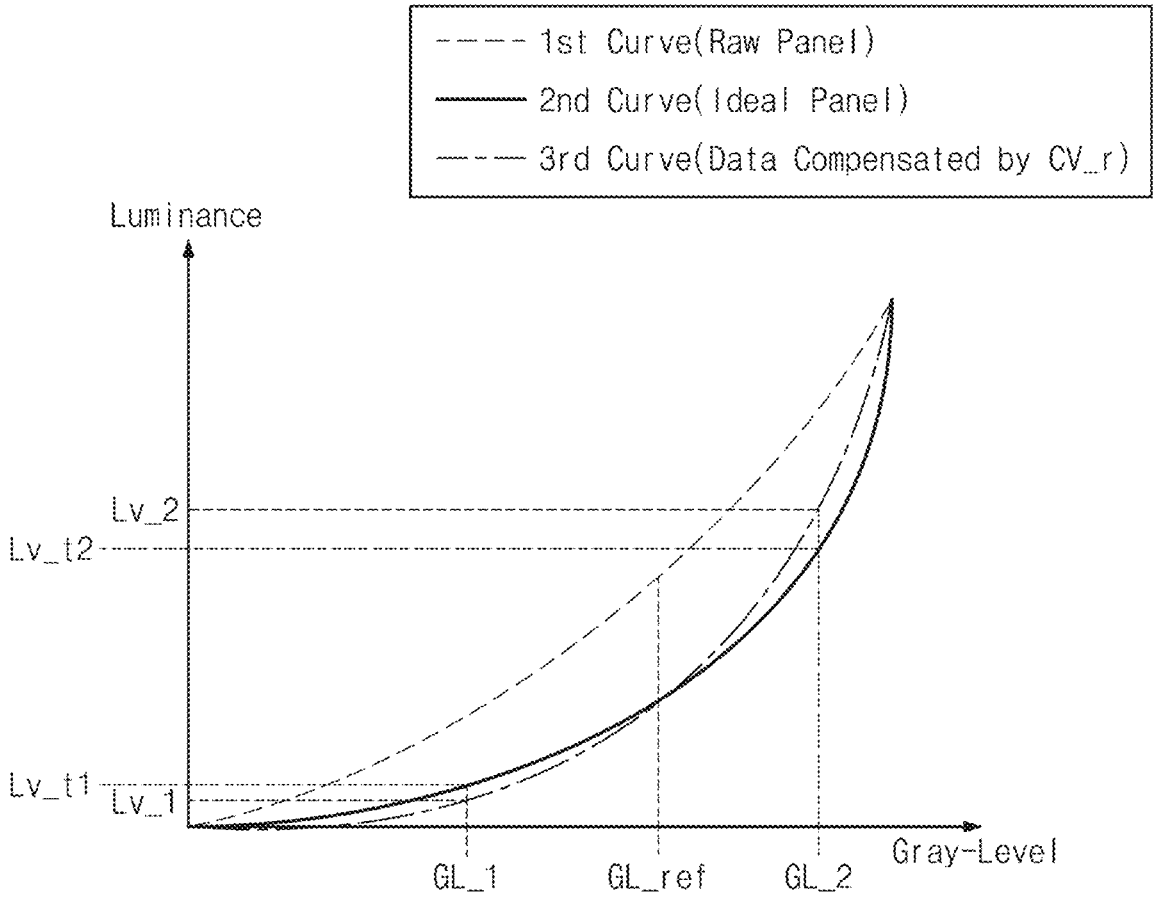
FIG. 3B (Related Art)

FIGS. 3A and 3B are graphs for describing a MURA compensation operation using a reference look-up table. In graphs of FIGS. 3A and 3B, a horizontal axis represents a gray level of a specific pixel of a plurality of pixels included in the display panel DP and a vertical axis represents luminance expressed from the specific pixel of the plurality of pixels included in the display panel DP.

Referring to FIGS. 1, 3A, and 3B, in the case where the MURA compensation operation is not performed (i.e., in the case of a raw display panel), the specific pixel of the plurality of pixels of the display panel DP may express luminance of first curves of FIGS. 3A and 3B at a plurality of gray levels. In the case where the MURA compensation operation is performed based on the reference look-up table LUT_ref or the reference correction value CV_ref, the specific pixel of the plurality of pixels of the display panel DP may express luminance of third curves of FIGS. 3A and 3B at the plurality of gray levels.

For example, the MURA compensation operation based on the reference look-up table LUT_ref may be performed by changing a gray level value of data to be provided to a specific pixel based on a reference compensation value CV_ref corresponding to the specific pixel from among a plurality of reference compensation values CV_ref of the reference look-up table LUT_ref. For example, like the first curve of FIG. 3A, the specific pixel may express luminance Lv_r when data of the reference gray level GL_ref is provided thereto. In this case, at the reference gray level GL_ref, target luminance Lv_t may be expressed by the ideal display panel, like the second curve of FIG. 3A. As such, in the case where the input data DT_in of the specific pixel indicate the reference gray level GL_ref, the specific pixel may express the target luminance Lv_t by adjusting the gray level of the input data DT_in of the specific pixel to a target gray level GL_t based on the reference compensation value CV_ref corresponding to the specific pixel. The above MURA compensation operation may be performed for each of the plurality of pixels, based on reference compensation values CV_ref of the reference look-up table LUT_ref described above.

As described above, the MURA of the display panel DP may be compensated by performing the MURA compensation operation by using the reference look-up table LUT_ref. In an exemplary embodiment, because the reference look-up table LUT_ref is extracted based on a reference gray level being a specific gray level of a plurality of gray levels expressible by the display panel DP, the MURA compensation performed with regard to the reference gray level may be relatively accurate. In contrast, the accuracy of the MURA compensation performed with regard to gray levels different from the reference gray level may decrease.

For example, like the second curve of FIG. 3B, luminance of the reference gray level GL_ref may be compensated to be substantially identical to luminance (i.e., the second curve) of the ideal display panel but may be different from luminance (i.e., the second curve) of the ideal display panel at a first gray level GL_1 and a second gray level GL_2. In detail, in the case where the MURA compensation is performed based on the reference look-up table LUT_ref, a luminance value may be adjusted to the first luminance Lv_1 at the first gray level GL_1 and may be adjusted to the second luminance Lv_2 at the second gray level GL_2. However, an ideal luminance value associated with the first gray level GL_1 may be first target luminance Lv_t1 brighter than the first luminance Lv_1 and an ideal luminance value associated with the second gray level GL_2 may be second target luminance Lv_t2 darker than the second luminance Lv2.

That is, in the case of the MURA compensation based on the reference look-up table LUT_ref, the MURA compensation performed with regard to the reference gray level GL_ref may be relatively accurate, while the MURA compensation performed with regard to gray levels different from the reference gray level GL_ref may not be accurate. In other words, at gray levels different from the reference gray level GL_ref, weak compensation or strong compensation may occur. That is, in the case where various gray levels are expressed by the display panel DP, the MURA may not be compensated or removed normally.

The MURA compensation circuit 110 of the display driving circuit 100 according to an embodiment of the disclosure may perform a first MURA compensation operation based on the reference look-up table LUT_ref, may calculate a second compensation value based on a gray level period of input data, and may perform a second MURA compensation operation on a result of the first MURA compensation operation based on the second compensation value thus calculated. Accordingly, even though various gray levels are expressed by the display panel DP, the MURA occurring at the display panel DP may be normally compensated or removed, or luminance irregularity may be prevented.

Figure 4:
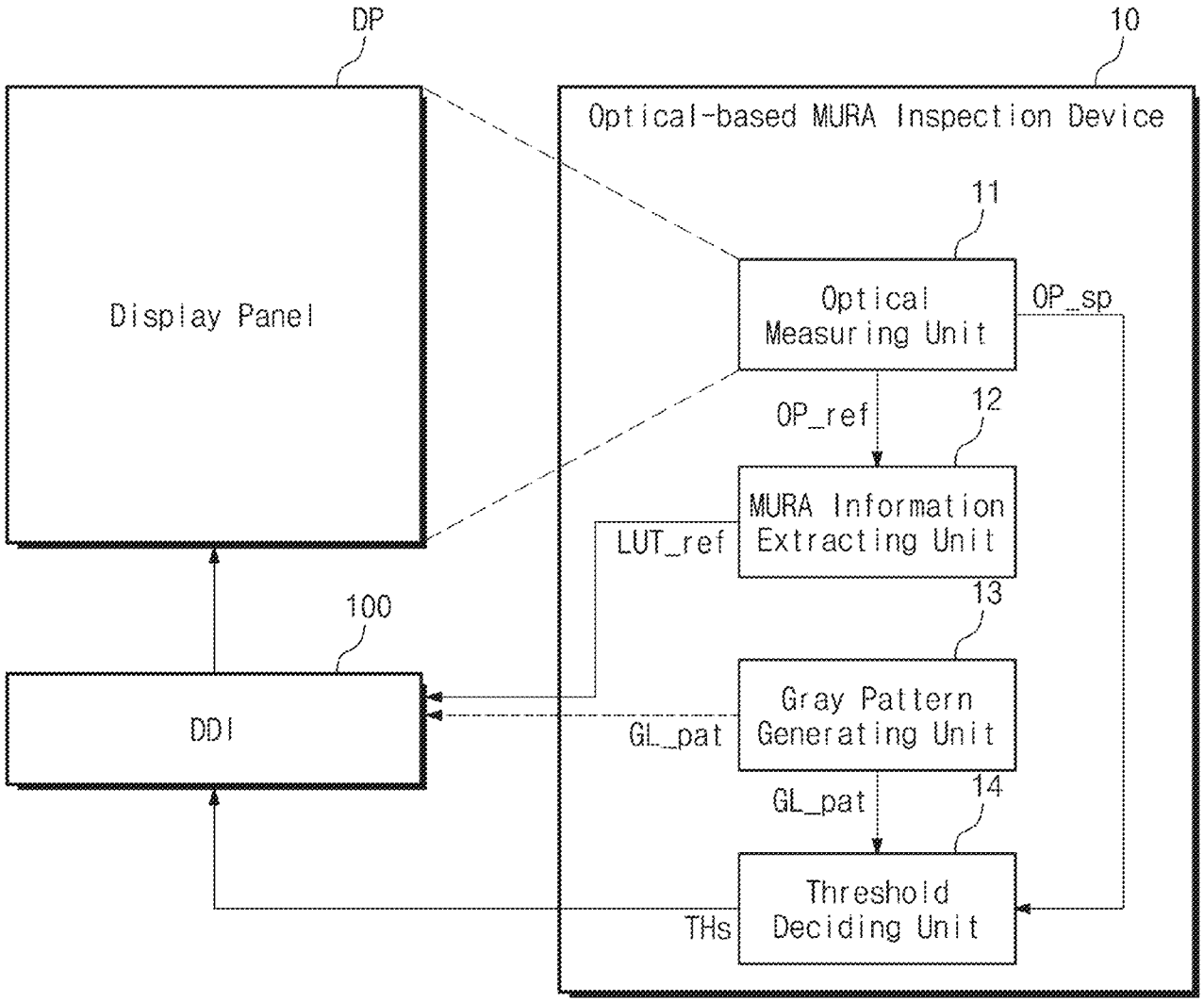
FIG. 4 is a block diagram illustrating a MURA preventing system of a display panel according to an embodiment of the disclosure.

FIG. 4 is a block diagram illustrating a MURA preventing system of a display panel according to an embodiment of the disclosure. For convenience of description, additional description associated with the components described above will be omitted to avoid redundancy. Referring to FIGS. 1 and 4, an optical-based MURA inspection device 10 may perform a MURA inspection operation for extracting or generating information necessary to compensate the MURA occurring at the display device DPD or the display panel DP. The optical-based MURA inspection device 10 may include an optical measuring unit 11, a MURA information extracting unit 12, a gray pattern generating unit 13, and a threshold deciding unit 14.

The optical measuring unit 11 may measure the reference optical information OP_ref received from the display panel DP, which is controlled based on the reference gray level GL_ref, and the MURA information extracting unit 12 may extract the reference look-up table LUT_ref based on the reference optical information OP_ref. This is described above, and thus, additional description will be omitted to avoid redundancy.

The gray pattern generating unit 13 may generate a gray level pattern GL_pat associated with a plurality of gray levels expressible by the display panel DP. For example, the gray pattern generating unit 13 may generate the gray level pattern GL_pat such that the display panel DP expresses specific gray levels sequentially and respectively. The specific gray levels may include the plurality of gray levels or may include some gray levels sampled from the plurality of gray levels. The display driving circuit (DDI) 100 may control the display panel DP based on the gray level pattern GL_pat received from the gray pattern generating unit 13.

The optical measuring unit 11 may measure supplementary optical information OP_sp from the display panel DP that sequentially expresses a plurality of gray levels based on the gray level pattern GL_pat. In an exemplary embodiment, the supplementary optical information OP_sp associated with the display panel DP may indicate image information corresponding to each of the plurality of gray levels included in the gray level pattern GL_pat.

The threshold deciding unit 14 may decide thresholds THs based on the supplementary optical information OP_sp received from the optical measuring unit 11 and information about the gray level pattern GL_pat received from the gray pattern generating unit 13. In an exemplary embodiment, the thresholds THs may be values respectively corresponding to some gray levels of the plurality of gray levels and may be used to determine a gray level period of the input data DT_in provided to the display driving circuit 100. The threshold deciding unit 14 may store information about the decided thresholds THs in the display driving circuit 100 (e.g., the storage circuit 120). A configuration of the thresholds THs will be more fully described with reference to drawings below.

In an exemplary embodiment, the display driving circuit 100 may perform the first MURA compensation operation on the input data DT_in based on the reference look-up table LUT_ref. Afterwards, the display driving circuit 100 may determine a gray level period of the input data DT_in based on the threshold THs and may further perform the second MURA compensation operation on a result of the first MURA compensation operation by using a supplementary compensation value decided based on the determined gray level period. Accordingly, the MURA (i.e., the MURA not removed by the first MURA compensation) occurring at various gray levels, which is described with reference to FIG. 3B, may be normally removed.

Figure 5:
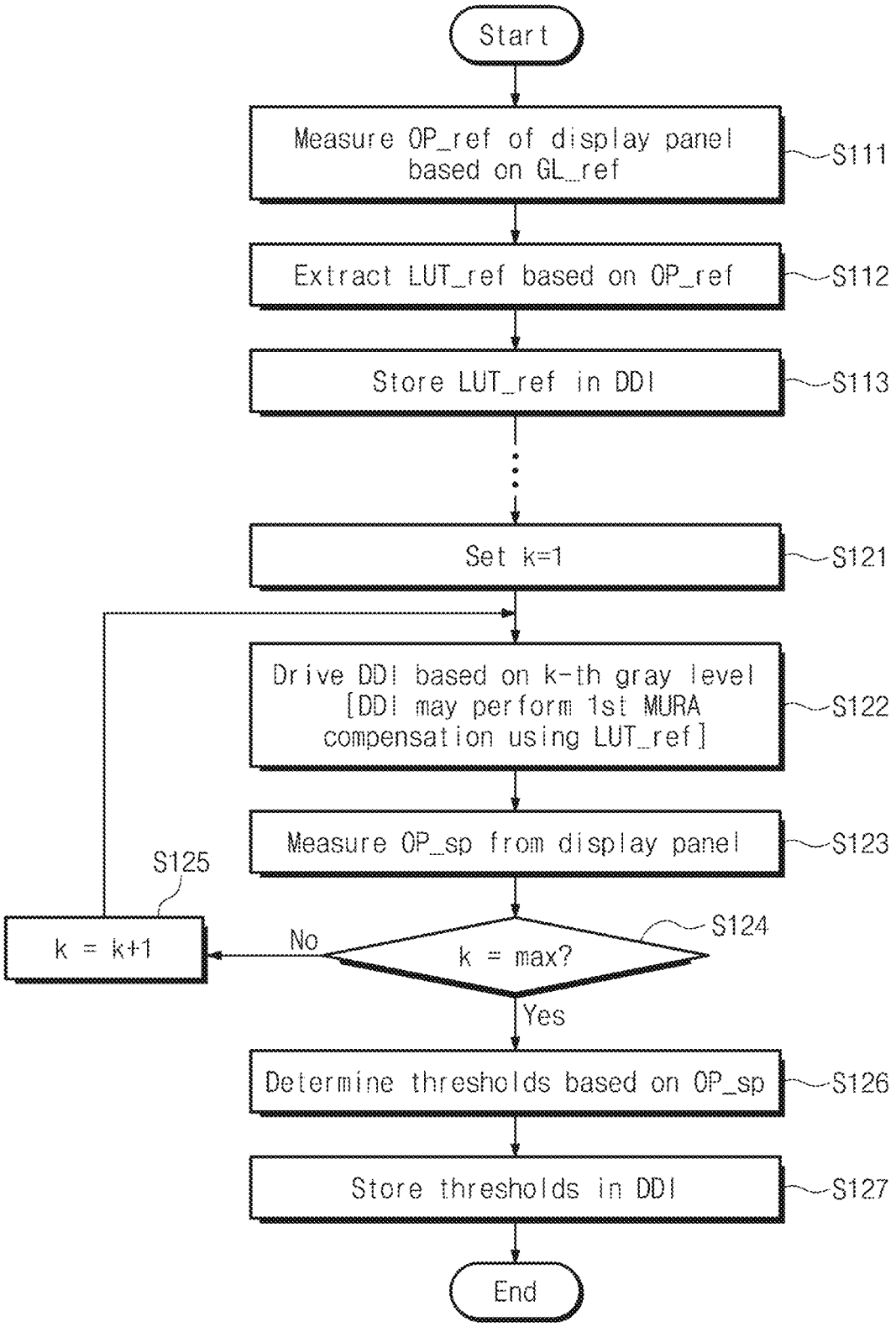
FIG. 5 is a flowchart illustrating an operation of an optical-based MURA inspection device of FIG. 4.
Figure 6A:
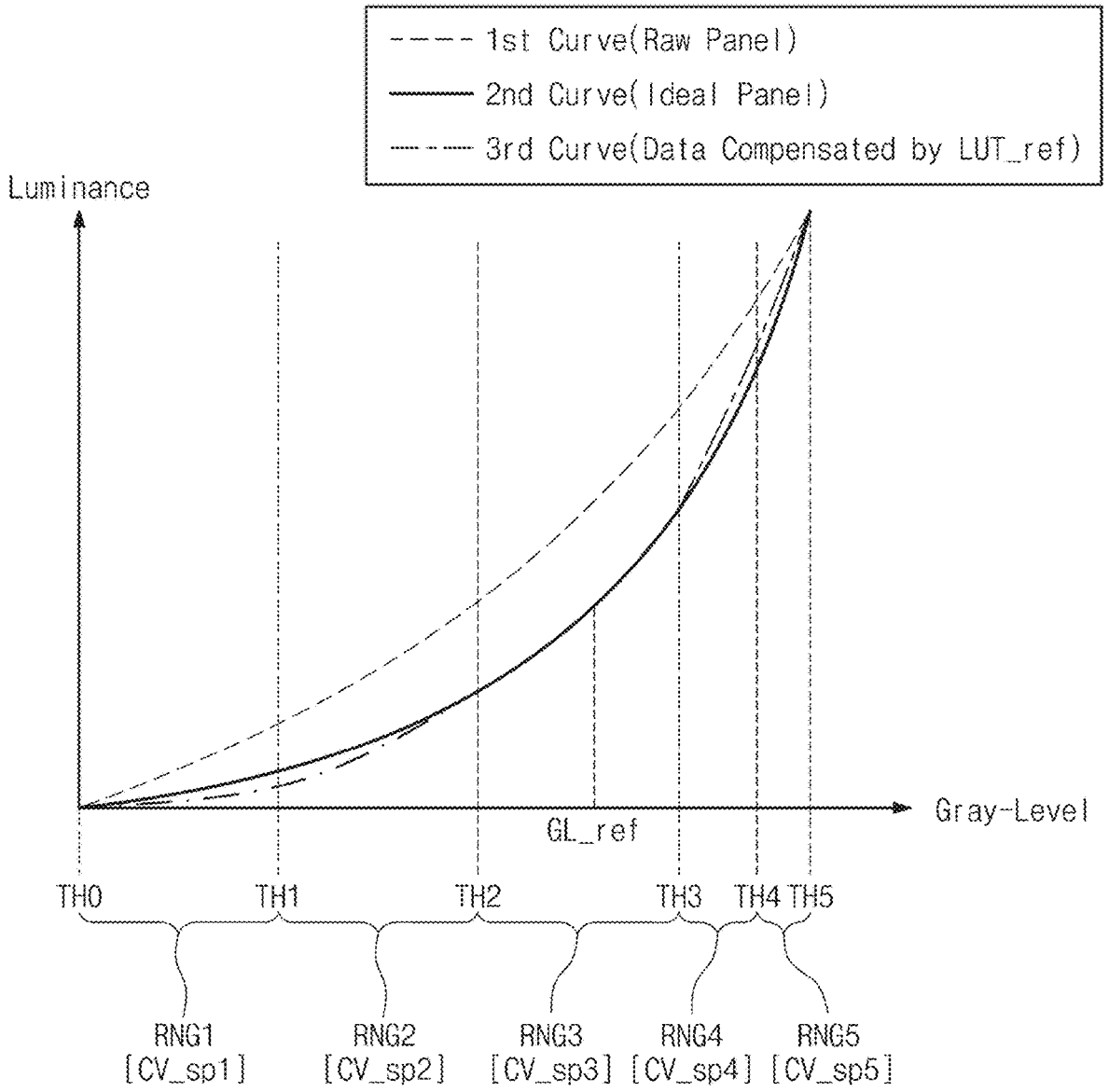
FIGS. 6A to 6C are diagrams for describing a configuration of deciding a threshold of an optical-based MURA inspection device.
Figure 6B:
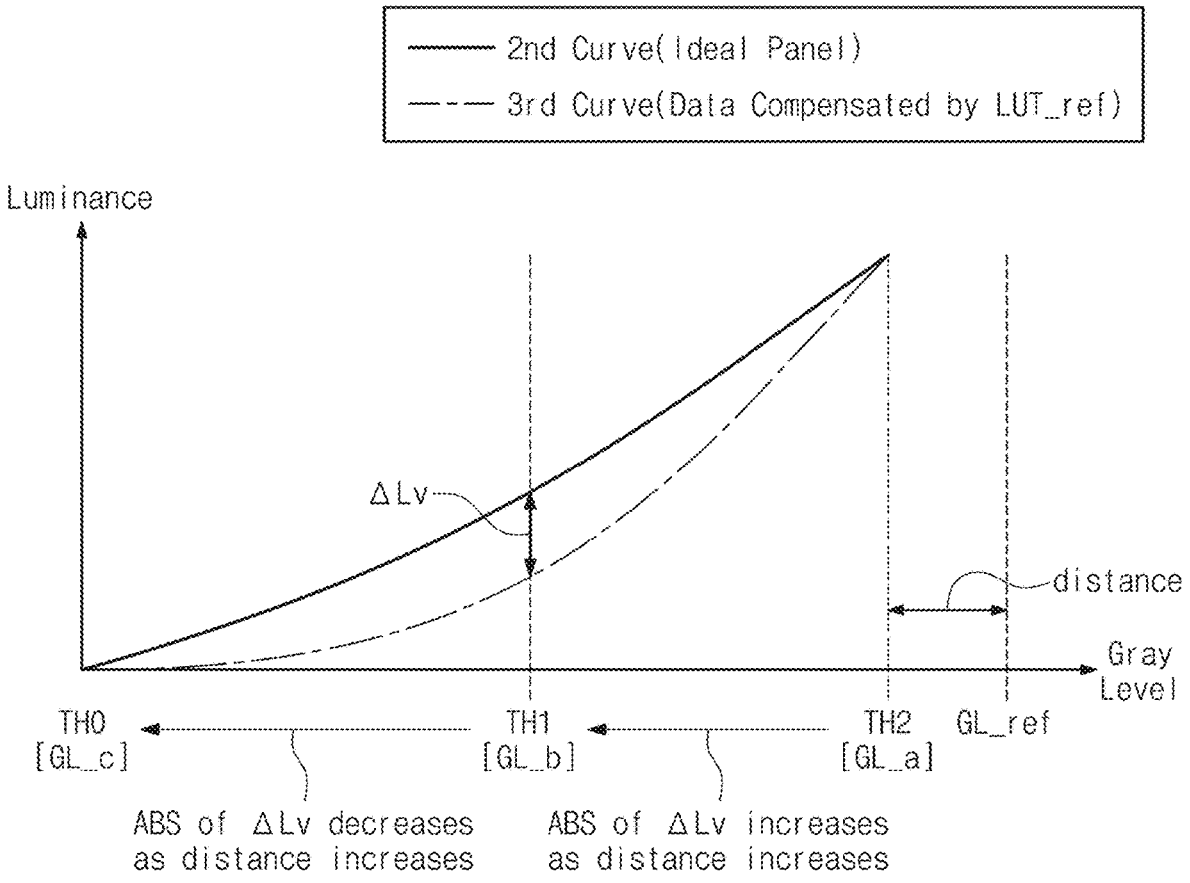
Figure 6C:
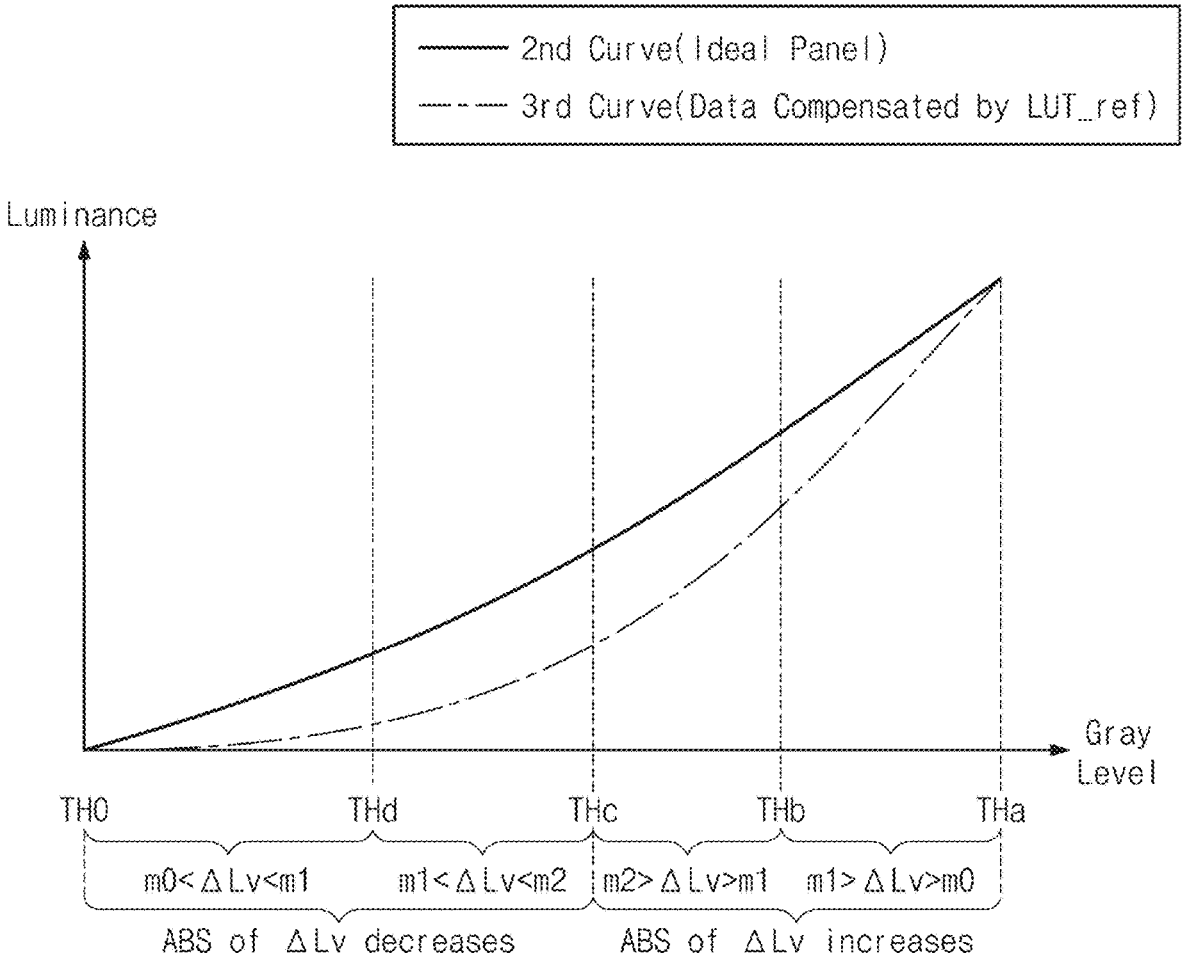

FIG. 5 is a flowchart illustrating an operation of an optical-based MURA inspection device of FIG. 4. FIGS. 6A to 6C are diagrams for describing a configuration of deciding a threshold of an optical-based MURA inspection device. In graphs of FIGS. 6A to 6C, a horizontal axis represents a gray level and a vertical axis represents luminance. In FIGS. 6A to 6C, first curves indicate a gray level-luminance relationship associated with the display panel DP to which the MURA compensation is not applied, second curves indicate a gray level-luminance relationship associated with the ideal display panel, and third curves indicate a gray level-luminance relationship associated with the display panel DP to which the first MURA compensation based on the reference look-up table LUT_ref is applied. For brevity of illustration and convenience of description, with regard to the above-described components, additional description will be omitted to avoid redundancy.

Referring to FIGS. 4 and 5, in operation S111, the optical-based MURA inspection device 10 may measure the reference optical information OP_ref from the display panel DP, which is controlled based on the reference gray level GL_ref. For example, the display driving circuit 100 may control the display panel DP based on the reference gray level GL_ref. In this case, the optical measuring unit 11 of the optical-based MURA inspection device 10 may measure image information of the front surface of the display panel DP, that is, the reference optical information OP_ref.

In operation S112, the optical-based MURA inspection device 10 may extract the reference look-up table LUT_ref based on the reference optical information OP_ref. For example, the MURA information extracting unit 12 of the optical-based MURA inspection device 10 may detect information (e.g., a pixel location) about a region where luminance imbalance occurs and a luminance difference in the region where the luminance imbalance occurs, based on the reference optical information OP_ref, and may extract the reference look-up table LUT_ref based on a result of the detection. The reference look-up table LUT_ref is described with reference to FIG. 2C, and thus, additional description will be omitted to avoid redundancy.

In operation S113, the optical-based MURA inspection device 10 may store the extracted reference look-up table LUT_ref in the display driving circuit 100 (e.g., the storage circuit 120).

Afterwards, in operation S121, a variable "k" may be set to "1". In an exemplary embodiment, the variable "k" is only for describing an iterative operation of the optical-based MURA inspection device 10, not intended to limit the disclosure.

In operation S122, the optical-based MURA inspection device 10 may control the display driving circuit 100 based on a k-th gray level. In this case, the display driving circuit 100 may control the display panel DP based on the k-th gray level under control of the optical-based MURA inspection device 10. In this case, the display panel DP may output information corresponding to the k-th gray level. In an exemplary embodiment, in operation S122, the display driving circuit 100 may control the display panel DP based on the data on which the first MURA compensation is performed using the reference look-up table LUT_ref. That is, in operation S122, a gray level expressed through the display panel DP may be a gray level to which the first MURA compensation based on the reference look-up table LUT_ref is applied.

In operation S123, the optical-based MURA inspection device 10 may measure the supplementary optical information OP_sp from the display panel DP. For example, the optical measuring unit 11 of the optical-based MURA inspection device 10 may measure the supplementary optical information OP_sp from the display panel DP, which is controlled based on the k-th gray level.

In operation S124, the optical-based MURA inspection device 10 may determine whether the variable "k" is a maximum value. That is, the optical-based MURA inspection device 10 may determine whether the supplementary optical information OP_sp is measured at each of a plurality of gray levels expressible by the display panel DP or at each of some gray levels (e.g., gray levels sampled to decide a threshold from among the plurality of gray levels) determined in advance.

When the variable "k" is not the maximum value, that is, when a gray level to be measured as the supplementary optical information OP_sp exists, in operation S125, the variable "k" may increase by "1" and the optical-based MURA inspection device 10 may perform operation S122.

In an exemplary embodiment, operation S121 to operation S125 that constitute the iterative operation may be repeatedly performed by the optical measuring unit 11 and the gray pattern generating unit 13 of the optical-based MURA inspection device 10. For example, as described above, the gray pattern generating unit 13 may generate the gray level pattern GL_pat such that all gray levels or some gray levels are sequentially expressed through the display panel DP. The optical measuring unit 11 may measure the supplementary optical information OP_sp, which is associated with each of all the gray levels or some gray levels, from the display panel DP that sequentially expresses all the gray levels or some gray levels based on the gray level pattern GL_pat. In this case, the display driving circuit 100 may perform the first MURA compensation on pattern data corresponding to the gray level pattern GL_pat based on the reference look-up table LUT_ref and may control the display panel DP based on first compensation pattern data. That is, the supplementary optical information OP_sp measured based on the gray level pattern GL_pat may correspond to information on which the first MURA compensation based on the reference look-up table LUT_ref is performed.

That is, in the flowchart of FIG. 5, the iterative operation obtains the supplementary optical information OP_sp at each of all gray levels or for each of some gray levels; however, as the gray level pattern GL_pat generated by the gray pattern generating unit 13 is used, the configuration for obtaining the supplementary optical information OP_sp at each of all gray levels or for each of some gray levels may be performed by a single operation or by a single group of operations.

When the variable "k" is the maximum value, that is, when a gray level to be measured as the supplementary optical information OP_sp does not exist, in operation S126, the optical-based MURA inspection device 10 may decide the thresholds THs based on the supplementary optical information OP_sp. In operation S127, the optical-based MURA inspection device 10 may store the decided thresholds THs in the display driving circuit 100.

As a detailed example of operation S126, as illustrated in FIG. 6A, because the supplementary optical information OP_sp is image information obtained from the display panel DP to which the first MURA compensation based on the reference look-up table LUT_ref is applied, the supplementary optical information OP_sp may correspond to the third curve. The threshold deciding unit 14 may obtain information of the third curve based on the supplementary optical information OP_sp that is obtained from the display panel DP to which the first MURA compensation based on the reference look-up table LUT_ref is applied, and the threshold deciding unit 14 may decide the thresholds THs used to determine a period of the input data DT_in based on the third curve and the second curve (i.e., information about the ideal display panel).

As a detailed example, as illustrated in FIG. 6A, the threshold deciding unit 14 of the optical-based MURA inspection device 10 may divide a plurality of gray levels expressible by the display panel DP (or gray levels of the input data DT_in) into first to fifth gray level periods RNG1 to RNG5, based on the supplementary optical information OP_sp (i.e., the third curve). The threshold deciding unit 14 may decide zeroth to fifth thresholds TH0 to TH5 for the purpose of dividing the plurality of gray levels into the first to fifth gray level periods RNG1 to RNG5.

In an exemplary embodiment, the display driving circuit 100 may determine a gray level period corresponding to the input data DT_in based on the input data DT_in and the thresholds TH0 to TH5 and may perform the second MURA compensation operation based on a supplementary compensation value CV_sp corresponding to the determined gray level period. For example, when the input data DT_in are included between the zeroth and first thresholds TH0 and TH1, the display driving circuit 100 may perform the second MURA compensation operation based on a first supplementary compensation value CV_sp1; when the input data DT_in are included between the first and second thresholds TH1 and TH2, the display driving circuit 100 may perform the second MURA compensation operation based on a second supplementary compensation value CV_sp2; when the input data DT_in are included between the second and third thresholds TH2 and TH3, the display driving circuit 100 may perform the second MURA compensation operation based on a third supplementary compensation value CV_sp3; when the input data DT_in are included between the third and fourth thresholds TH3 and TH4, the display driving circuit 100 may perform the second MURA compensation operation based on a fourth supplementary compensation value CV_sp4; and when the input data DT_in are included between the fourth and fifth thresholds TH4 and TH5, the display driving circuit 100 may perform the second MURA compensation operation based on a fifth supplementary compensation value CV_sp5. In an exemplary embodiment, the first to fifth supplementary compensation values CV_sp1 to CV_sp5 of the first to fifth gray level periods RNG1 to RNG5 may be variable values that are decided by the corresponding coefficients and variables. The second MURA compensation operation using a supplementary compensation value will be more fully described with reference to drawings below.

In an exemplary embodiment, the threshold deciding unit 14 may decide the thresholds THs used to determine a gray level period of the input data DT_in based on a variety of information such as a distance from the reference gray level GL_ref, a magnitude of a luminance difference (e.g., an absolute value of a luminance difference), and a polarity or direction of a luminance difference (e.g., a negative direction or a positive direction). For example, FIGS. 6B and 6C are graphs illustrating luminance versus gray levels between the zeroth and second thresholds TH0 and TH2. As illustrated in FIG. 6B, in the second gray level period RNG2 defined by the first and second thresholds TH1 and TH2, as a distance from the reference gray level GL_ref increases, for example, as a gray level decreases, an absolute value of the luminance difference ΔLv may increase.

By contrast, in the first gray level period RNG1 defined by the zeroth and first thresholds TH0 and TH1, as a distance from the reference gray level GL_ref increases, for example, as a gray level decreases, an absolute value of the luminance difference ΔLv may decrease.

In this case, the threshold deciding unit 14 may decide a gray level of GL_a as the second threshold TH2, may decide a gray level of GL_b as the first threshold TH1, and may decide a gray level of GL_c as the zeroth threshold TH0. That is, as illustrated in FIG. 6B, the threshold deciding unit 14 may divide a plurality of gray levels into a plurality of periods, based on a magnitude of a luminance difference according to a gray level distance.

Alternatively, as illustrated in FIG. 6C, the threshold deciding unit 14 may decide thresholds TH0 and THa to THd in a specific gray level period or the whole gray level period. For example, in a period from THa to THc, as a distance from the reference gray level GL_ref increases, an absolute value of the luminance difference ΔLv may increase. In this case, in the period from THa to THb, the luminance difference ΔLv may be between a zeroth value m0 and a first value m1; and, in a period from THb to THc, the luminance difference ΔLv may be between the first value m1 and a second value m2. In this case, the threshold deciding unit 14 may decide the period from THa to THb as one period and may decide the period from THb to THc as another period. The threshold deciding unit 14 may decide thresholds of THa, THb, and THc for the purpose of determining the decided periods.

Likewise, in the period from THc to TH0, as a distance from the reference gray level GL_ref increases, an absolute value of the luminance difference ΔLv may decrease.

In this case, in a period from THc to THd, the luminance difference ΔLv may be between the first value m1 and the second value m2; and, in a period from THd to TH0, the luminance difference ΔLv may be between the zeroth value m0 and the first value m1. In this case, the threshold deciding unit 14 may decide the period from THc to THd as one period and may decide the period from THd to TH0 as another period. The threshold deciding unit 14 may decide thresholds of THc, THd, and TH0 for the purpose of determining the decided periods.

In an exemplary embodiment, in the case where "n" gray levels are expressible through the display panel DP, a plurality of gray level periods may be divided into "n" or less gray level periods.

As described above, the threshold deciding unit 14 may decide the thresholds THs used to determine a period of the input data DT_in based on a variety of information such as a distance from the reference gray level GL_ref, a magnitude of a luminance difference (i.e., an absolute value of a luminance difference), and a polarity or direction of a luminance difference (i.e., whether first MURA-compensated luminance is greater than a target luminance). In an exemplary embodiment, the variety of information may be obtained based on the supplementary optical information OP_sp corresponding to each of all gray levels or some gray levels.

Figure 7:
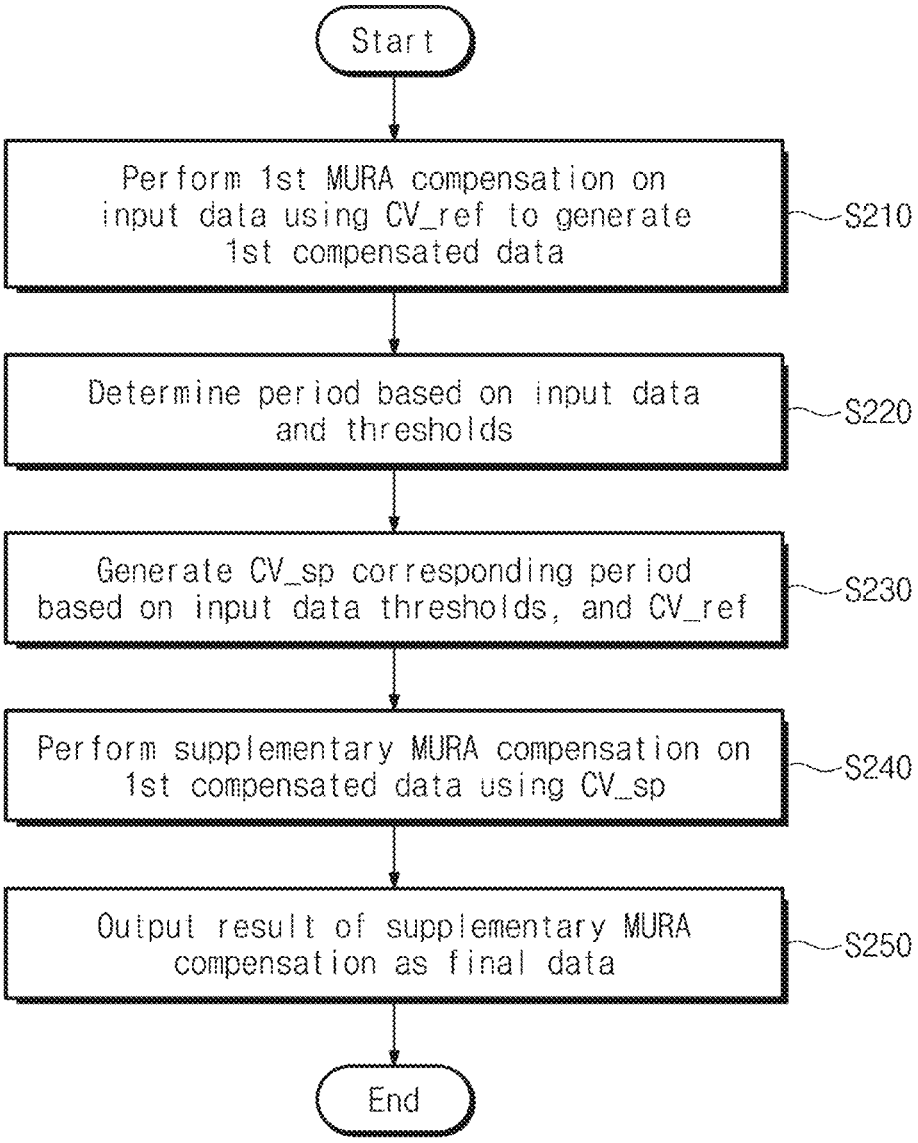
FIG. 7 is a flowchart illustrating a MURA compensation operation of a display driving circuit of FIG. 4.

FIG. 7 is a flowchart illustrating a MURA compensation operation of a display driving circuit of FIG. 4. In an exemplary embodiment, an operation according to the flowchart of FIG. 7 may indicate the MURA compensation operation in a normal operation of the display device DPD (e.g., an operation of an end-user). That is, information about the reference look-up table LUT_ref and the thresholds THs described with reference to FIGS. 1 to 6C may be extracted in the process of manufacturing the display device DPD or inspecting the display device DPD at the optical-based MURA inspection device 10 described with reference to FIG. 4 and may be stored in the display driving circuit 100. That is, before the operation of the flowchart of FIG. 7 is performed, the storage circuit 120 of the display driving circuit 100 may store information about the reference look-up table LUT_ref and the thresholds THs described with reference to FIGS. 1 to 6C.

For brevity of illustration and convenience of description, below, it is assumed that the MURA compensation operation of the display driving circuit 100 is performed on a specific pixel of a plurality of pixels of the display panel DP. That is, below, a variety of information that is used in the MURA compensation may be information corresponding to the specific pixel of the plurality of pixels. However, the disclosure is not limited thereto. The MURA compensation operation according to an embodiment of the disclosure may be performed on the plurality of pixels, independently or dependently.

Referring to FIGS. 1, 4, and 7, in operation S210, the display driving circuit 100 may perform the first MURA compensation on the input data DT_in based on the reference compensation value CV_ref of the reference look-up table LUT_ref and may generate first compensated data as a result of the first MURA compensation. For example, the MURA compensation circuit 110 of the display driving circuit 100 may perform the first MURA compensation operation on the input data DT_in based on the reference compensation value CV_ref of the reference look-up table LUT_ref. The MURA compensation operation (i.e., the first MURA compensation operation) based on the reference compensation value CV_ref of the reference look-up table LUT_ref is described with reference to FIGS. 3A and 3B, and thus, additional description will be omitted to avoid redundancy.

In operation S220, the display driving circuit 100 may determine a gray level period corresponding to the input data DT_in based on the input data DT_in and the thresholds THs. For example, as described above, the thresholds THs may be used to determine whether a gray level of the input data DT_in is included in any gray level period of a plurality of gray level periods. The MURA compensation circuit 110 of the display driving circuit 100 may determine whether the gray level of the input data DT_in is included in any gray level period of a plurality of gray level periods defined by the thresholds THs.

In operation S230, the display driving circuit 100 may generate the supplementary compensation value CV_sp corresponding to the determined gray level period, based on the input data DT_in, the thresholds THs, and the reference correction value CV_ref. For example, the MURA compensation circuit 110 of the display driving circuit 100 may generate the supplementary compensation value CV_sp corresponding to the determined gray level period, based on the input data DT_in, the thresholds THs, and the reference correction value CV_ref, as described with reference to FIG. 6A. In an exemplary embodiment, the supplementary compensation value CV_sp may linearly or non-linearly vary depending on a distance of the gray level of the input data DT_in (i.e., a difference with a reference gray level).

In operation S240, the display driving circuit 100 may perform supplementary MURA compensation (or the second MURA compensation) on the first compensated data, by using the supplementary compensation value CV_sp. For example, referring to FIG. 6A, in the case where the input data DT_in are included in the second gray level period RNG2, the supplementary compensation value may be decided as the second supplementary compensation value CV_sp2. In this case, the MURA compensation circuit 110 of the display driving circuit 100 may compensate or change a value (e.g., a gray level) of the first compensated data (e.g., the third curve of FIG. 6A) such that luminance increases by the second supplementary compensation value CV_sp2. Alternatively, in the case where the input data DT_in are included in the fourth gray level period RNG4, the supplementary compensation value may be decided as the fourth supplementary compensation value CV_sp4. In this case, the MURA compensation circuit 110 of the display driving circuit 100 may compensate or change a value (e.g., a gray level) of the first compensated data (e.g., the third curve of FIG. 6A) such that luminance decreases by the fourth supplementary compensation value CV_sp4.

In operation S250, the display driving circuit 100 may output a result of the supplementary MURA compensation as the final data DT_fin. In an exemplary embodiment, the final data DT_fin may be provided to the timing controller 130 of the display driving circuit 100, and the timing controller 130 may control the source driver 140, the row driver RD, or the display panel DP based on the final data DT_fin.

That is, as described above, the display driving circuit 100 according to an embodiment of the disclosure may perform the first MURA compensation operation on the input data DT_in based on the reference look-up table LUT_ref and may then perform the supplementary MURA compensation based on the supplementary compensation value CV_sp decided according to a gray level period of the input data DT_in. That is, even though the MURA compensation is performed based on the reference look-up table LUT_ref, an issue exists that the MURA is not normally compensated at the remaining gray levels other than the reference gray level. However, according to an embodiment of the disclosure, the above issue may be prevented because the second MURA compensation is performed based on the supplementary compensation value decided according to a gray level of input data.

In an exemplary embodiment, in the case where a gray level of the input data DT_in is included in a period (e.g., the third gray level period RNG3) where the reference gray level GL_ref is included, the supplementary MURA compensation may be omitted (that is, the third supplementary compensation value CV_sp3 being "0").

Figure 8:
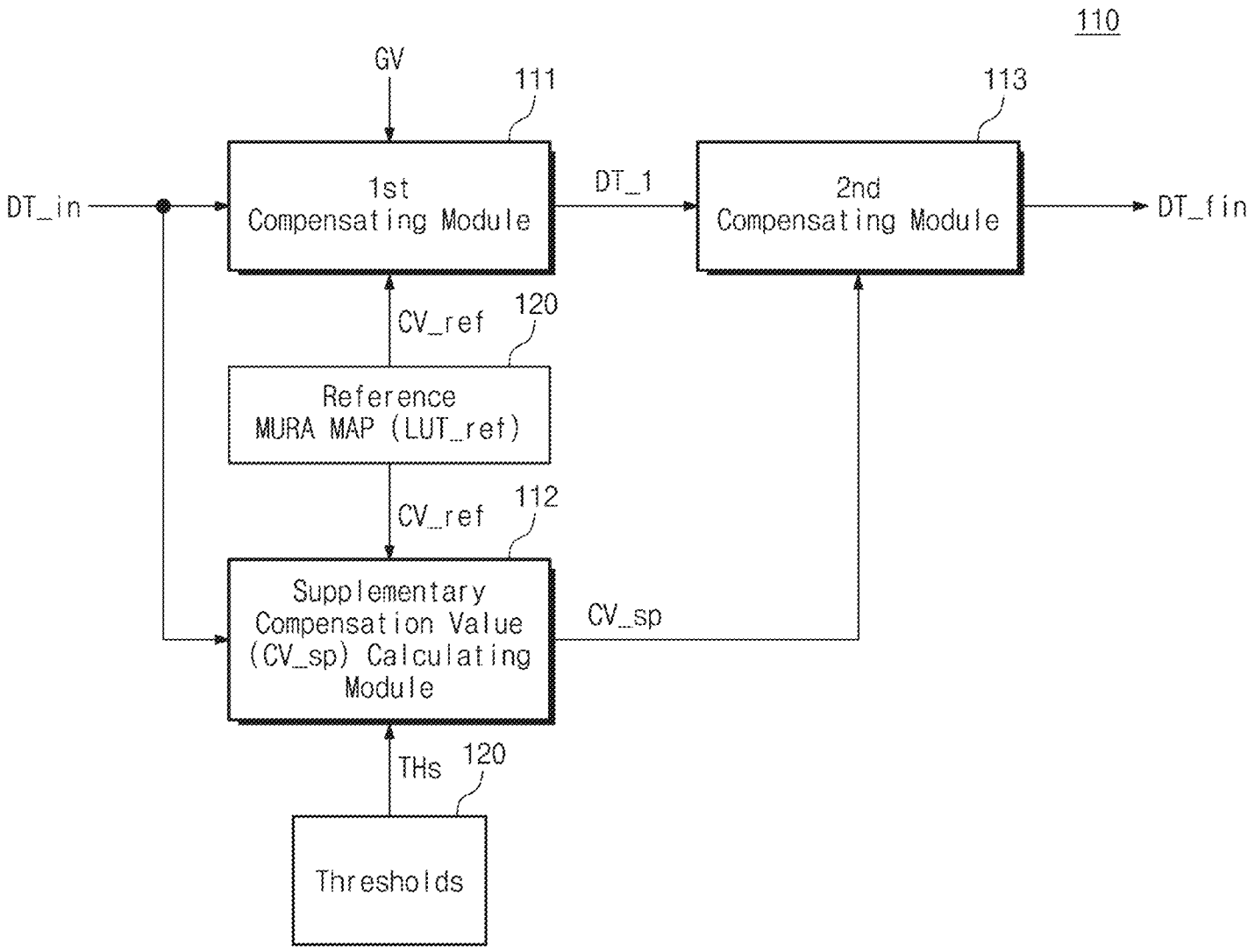
FIG. 8 is a block diagram illustrating a MURA compensation circuit of FIG. 1 in detail.
Figure 9A:
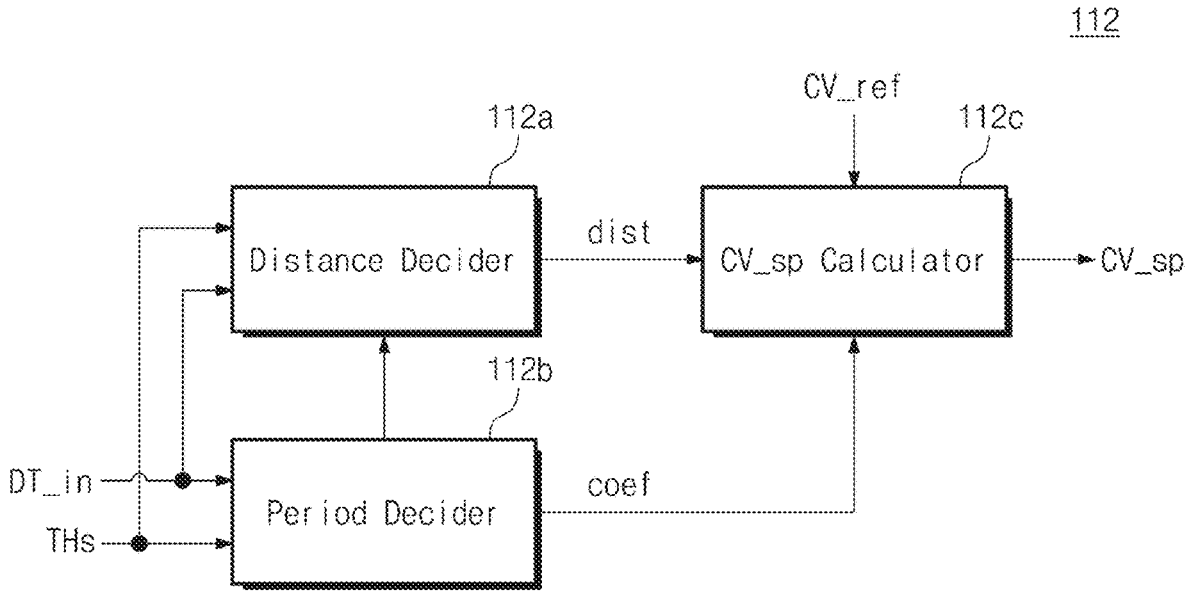
FIGS. 9A and 9B are diagrams for illustrating a supplementary compensation value calculating module of FIG. 8 in detail.
Figure 9B:
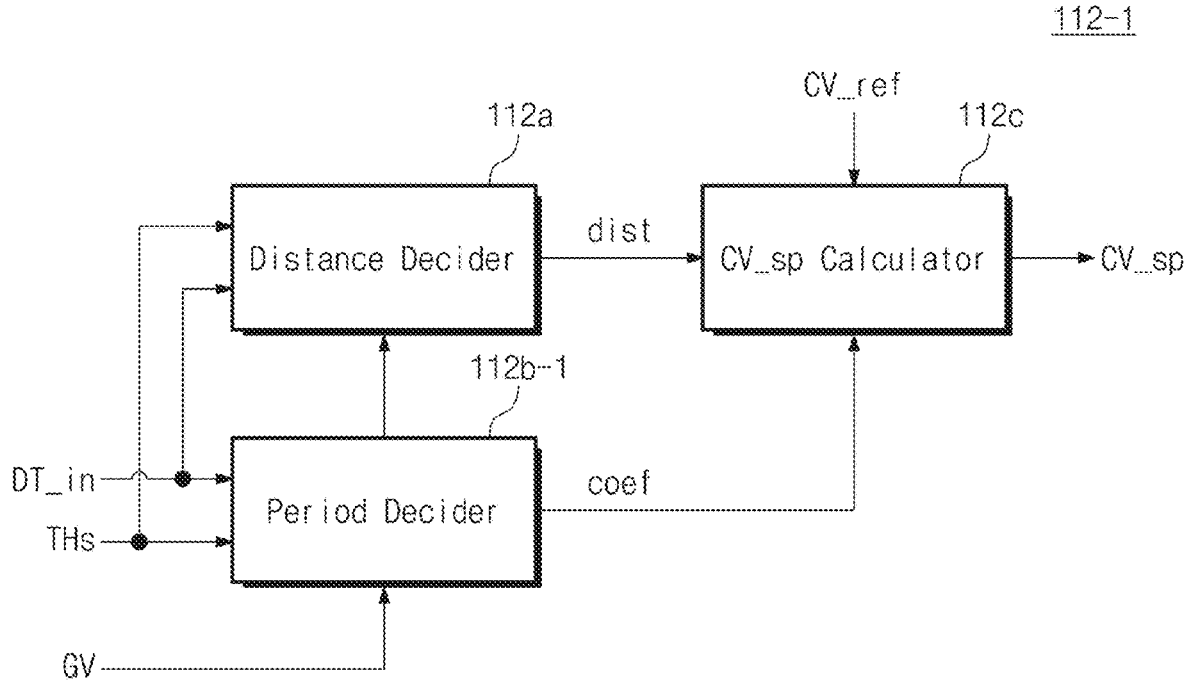

FIG. 8 is a block diagram illustrating a MURA compensation circuit of FIG. 1 in detail. FIGS. 9A and 9B are diagrams for illustrating a supplementary compensation value calculating module of FIG. 8 in detail. For convenience of description, additional description associated with the components described above will be omitted to avoid redundancy. Referring to FIGS. 1, 8, 9A, and 9B, the MURA compensation circuit 110 may include a first compensating module 111, a supplementary compensation value calculating module 112, and a second compensating module 113.

The first compensating module 111 may perform the first MURA compensation on the input data DT_in based on the reference look-up table LUT_ref. For example, the reference look-up table LUT_ref may include the reference correction value CV_ref for each of a plurality of pixels or for each of pixel groups and may be stored in the storage circuit 120. The input data DT_in may include gray level information about each of the plurality of pixels. The first compensating module 111 may perform the first MURA compensation on the input data DT_in based on the reference look-up table LUT_ref and gray level information of input data. The first MURA compensation based on the reference look-up table LUT_ref is described with reference to FIGS. 3A and 3B, and thus, additional description will be omitted to avoid redundancy.

In an exemplary embodiment, the first compensating module 111 may perform the first MURA compensation based on the gamma value GV set in advance by the external device. For example, a shape of a curve (i.e., a gamma curve) indicating a gray level-luminance relationship may vary depending on the gamma value GV. The first compensating module 111 may decide the reference compensation value CV_ref applied to the input data DT_in based on a gamma curve decided by the gamma value GV and may perform the first MURA compensation on the input data DT_in based on the decided reference compensation value CV_ref.

The supplementary compensation value calculating module 112 may calculate the supplementary compensation value CV_sp based on the input data DT_in, the thresholds THs stored in the storage circuit 120, and the reference look-up table LUT_ref. For example, the supplementary compensation value calculating module 112 may determine a gray level period in which a gray level corresponding to the input data DT_in is included, based on the thresholds THs. The supplementary compensation value calculating module 112 may calculate the supplementary compensation value CV_sp to be used in the second MURA compensation to be performed on first compensated data DT_1, based on information corresponding to the determined gray level period.

In detail, as illustrated in FIG. 9A, the supplementary compensation value calculating module 112 may include a distance decider 112*a*, a period decider 112*b*, and a supplementary compensation value calculator 112*c*.

The distance decider 112*a* may decide distance information dist based on the input data DT_in and the thresholds THs. For example, it is assumed that a gray level of the input data DT_in, which corresponds to a specific pixel, indicates a first gray level. In this case, the distance decider 112*a* may output a distance between the first gray level and the reference gray level GL_ref, that is, a difference of the first gray level and the reference gray level GL_ref as the distance information dist. Alternatively, the distance decider 112*a* may output a distance between the first gray level and the corresponding one of the thresholds THs as the distance information dist.

The period decider 112*b* may output a coefficient coef based on the input data DT_in and the thresholds THs. For example, the period decider 112*b* may decide a gray level period in which the gray level corresponding to the input data DT_in is included, based on the thresholds THs. The period decider 112*b* may output the coefficient coef corresponding to the decided gray level period. In detail, when the gray level of the input data DT_in is included in the first gray level period RNG1 of FIG. 6A, the period decider 112*b* may output a first coefficient; when the gray level of the input data DT_in is included in the fourth gray level period RNG4 of FIG. 6A, the period decider 112*b* may output a fourth coefficient.

In this case, the first coefficient may be a coefficient indicating the tendency that an absolute value of the luminance difference ΔLv decreases along a negative direction as a distance between the gray level of the input data DT_in and the reference gray level GL_ref increases. In contrast, the fourth coefficient may be a coefficient indicating the tendency that an absolute value of the luminance difference ΔLv increases along a positive direction as a distance between the gray level of the input data DT_in and the reference gray level GL_ref increases. In an exemplary embodiment, coefficients coef respectively corresponding to a plurality of periods may be in advance decided and stored by the optical-based MURA inspection device 10. In an exemplary embodiment, information about the coefficients coef may be stored in the storage circuit 120 of the display driving circuit 100.

That is, the period decider 112*b* may be configured to decide a gray level period corresponding to the gray level of the input data DT_in based on the thresholds THs decided in advance and to output the coefficient coef corresponding to the decided gray level period.

The supplementary compensation value calculator 112*c* may decide the supplementary compensation value CV_sp based on the reference compensation value CV_ref of the reference look-up table LUT_ref, the distance information dist from the distance decider 112*a*, and the coefficient coef from the period decider 112*b*. In an exemplary embodiment, the supplementary compensation value calculator 112*c* may calculate the supplementary compensation value CV_sp based on Equation 1 below.

$$CV_{sp}=CV_{ref}*(nor-\text{coef}*\text{dist}) \quad \text{[Equation 1]}$$

In Equation 1 above, "CV_sp" represents a supplementary compensation value, "CV_ref" represents a reference compensation value included in the reference look-up table LUT_ref, "coef" represents a coefficient decided by the period decider 112*b*, "dist" represents information about a distance decided by the distance decider 112*a*, and "nor" represents a normalization factor. That is, as understood from Equation 1 above, the coefficient coef corresponding to each of a plurality of gray level periods may be decided and the supplementary compensation value CV_sp may be decided depending on the decided coefficient coef and the distance information dist. In this case, the supplementary compensation value CV_sp for the second MURA compensation may be calculated for each of the plurality of gray level periods.

In an exemplary embodiment, as illustrated in FIG. 9B, a supplementary compensation value calculating module 112-1 may include the distance decider 112*a*, a period decider 112*b*-1, and the supplementary compensation value calculator 112*c*. The distance decider 112*a* and the supplementary compensation value calculator 112*c* are described above, and thus, additional description will be omitted to avoid redundancy. Unlike the period decider 112*b* of FIG. 9A, the period decider 112*b*-1 of FIG. 9A may use the gamma value GV when selecting the coefficient coef of a gray level period selected from a plurality of gray level periods. For example, as described above, at the same gray level, target luminance may non-linearly vary depending on a change in the gamma value GV. As such, the period decider 112*b*-1 may select the coefficient coef based on the gamma value GV, and thus, the accuracy of the supplementary compensation value CV_sp may be improved.

Returning to FIG. 8, the second compensating module 113 may generate the final data DT_fin by performing the second MURA compensation on the first compensated data DT_1, based on the supplementary compensation value CV_sp from the supplementary compensation value calculating module 112. For example, data (i.e., the first compensated data DT_1) experiencing the first MURA compensation may have a characteristic of the third curve described with reference to FIG. 6A. That is, even though the first MURA compensation based on the reference look-up table LUT_ref is performed, the first compensated data DT_1 may have a different characteristic from a characteristic (i.e., the second curve of FIG. 6A) of the ideal display panel. That is, in the case where the display panel DP is controlled based on the first compensated data DT_1, the MURA or the luminance imbalance may still occur.

In this case, the second compensating module 113 may generate the final data DT_fin by performing the second MURA compensation on the first compensated data DT_1, based on the supplementary compensation value CV_sp, thus removing the luminance imbalance. For example, as illustrated in FIG. 6A, in the case where a gray level of the input data DT_in is included in the first period RNG1 or the second period RNG2, the second compensating module 113 may perform the second MURA compensation on the first compensated data DT_1 based on the first supplementary compensation value CV_sp1 or the second supplementary compensation value CV_sp2, and thus, the luminance that are expressed based on the input data DT_in may increase from a magnitude of the third curve to a magnitude of the second curve. Alternatively, in the case where a gray level of the input data DT_in is included in the fourth period RNG4 or the fifth period RNG5, the second compensating module 113 may perform the second MURA compensation on the first compensated data DT_1 based on the fourth supplementary compensation value CV_sp4 or the fifth supplementary compensation value CV_sp5, and thus, the luminances that are expressed based on the input data DT_in may decrease from a magnitude of the third curve to a magnitude of the second curve. In an exemplary embodiment, in the case where a gray level of the input data DT_in is included in the third period RNG3 including the reference gray level GL_ref, the second compensating module 113 may omit the second MURA compensation. That is, the third supplementary compensation value CV_sp3 corresponding to the third period RNG3 may correspond to "0".

That is, in the embodiment of FIG. 6A, the reference correction value CV_ref may have a negative polarity (i.e., the first MURA compensation is performed in a luminance-decreasing direction) at all gray levels. However, the supplementary compensation values CV_sp1 and CV_sp2 may have a positive polarity (i.e., the second MURA compensation is performed in a luminance-increasing direction) in the first and second gray level periods RNG1 and RNG2, and the supplementary compensation values CV_sp4 and CV_sp5 may have a negative polarity (i.e., the second MURA compensation is performed in a luminance-decreasing direction) in the fourth and fifth gray level periods RNG4 and RNG5. In other words, at all gray levels, the first MURA compensation using a reference look-up table may be performed in one of a luminance-decreasing direction and a luminance-increasing direction, but the second MURA compensation according to an embodiment of the disclosure may be performed in a luminance-decreasing direction or a luminance-increasing direction depending on a gray level period.

An example where the reference correction value CV_ref is of a negative polarity is described in drawings, but the disclosure is not limited thereto. For example, the reference correction value CV_ref corresponding to a positive polarity or a negative polarity may be set for each of a plurality of pixels.

As described above, a conventional MURA compensation circuit performs only the first MURA compensation based on the reference look-up table LUT_ref. In this case, because the reference look-up table LUT_ref is information extracted based on the reference gray level GL_ref, the MURA compensation performed on the reference gray level GL_ref may be relatively accurate. However, strong compensation or weak compensation may occur at the remaining gray levels, thereby causing an issue that the MURA is not normally removed.

The display driving circuit 100 according to an embodiment of the disclosure may decide a gray level period, in which a gray level of the input data DT_in is included, based on the thresholds THs decided in advance by the optical-based MURA inspection device 10 and may perform the second MURA compensation on the first compensated data (i.e., the first compensated data DT_1) based on the supplementary compensation value CV_sp corresponding to the decided gray level period. Accordingly, a performance of the MURA compensation or the quality of an image to be displayed may be improved at all gray levels expressible by the display panel DP.

Figure 10:
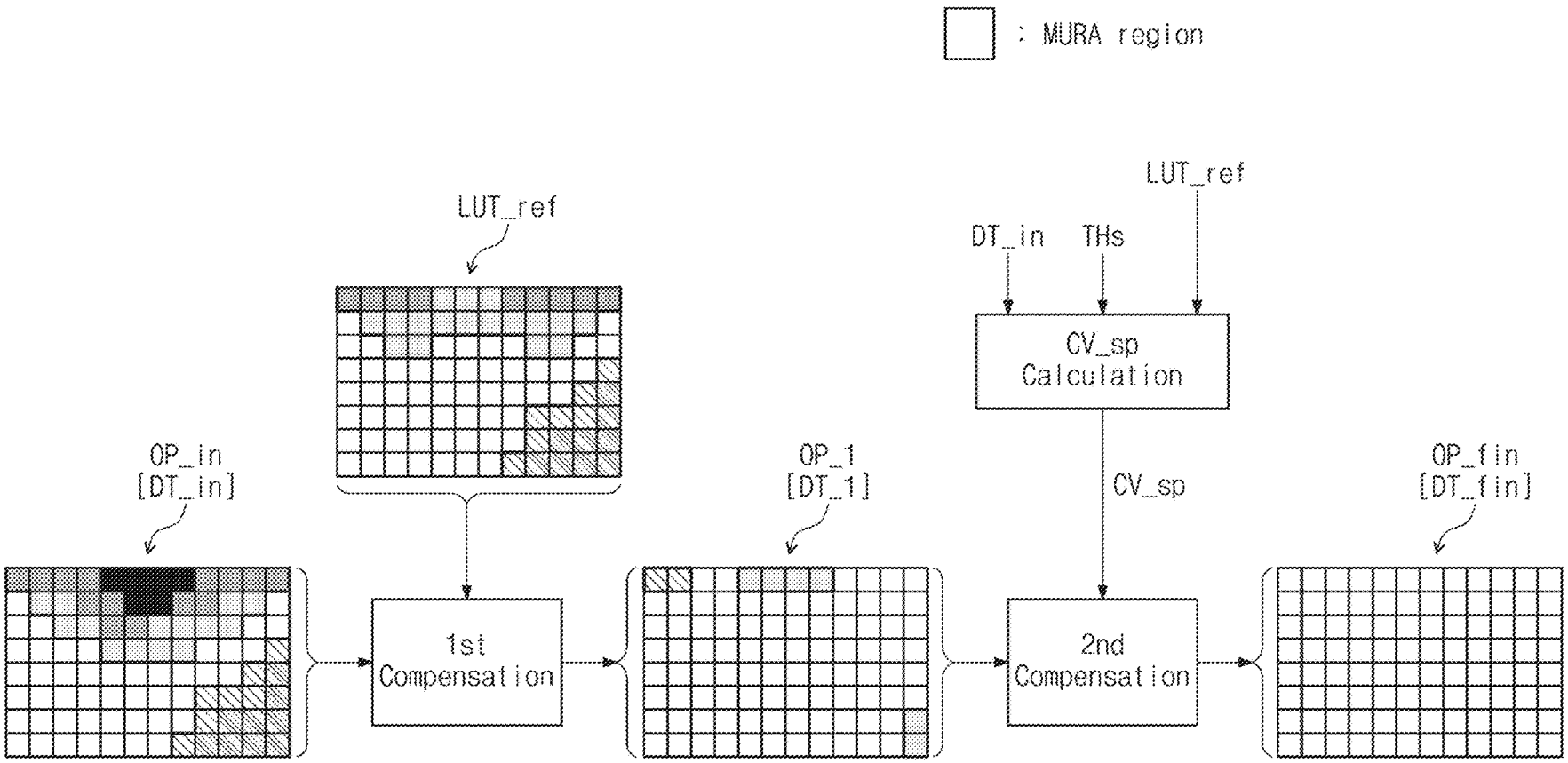
FIG. 10 is a diagram for describing a MURA compensation effect according to a MURA compensation circuit of FIG. 8.

FIG. 10 is a diagram for describing a MURA compensation effect according to a MURA compensation circuit of FIG. 8. For brevity of illustration and for convenience of description, components that are unnecessary to describe the MURA compensation effect are omitted. For convenience of description, the MURA compensation is performed on optical information, but the disclosure is not limited thereto. For example, the fact that compensated optical information is generated as a result of performing the MURA compensation on specific optical information means that the MURA compensation is performed on data corresponding to the specific optical information and optical information corresponding to the MURA-compensated data is measured.

Referring to FIGS. 1, 8, and 10, input optical information OP_in corresponding to the input data DT_in may be obtained. For example, the display driving circuit 100 may control the display panel DP based on the input data DT_in, without separate MURA compensation. The input optical information OP_in may be image information obtained from the display panel DP controlled without the MURA compensation. As illustrated in FIG. 10, the input optical information OP_in may include MURA regions. In an exemplary embodiment, a gray level corresponding to the input optical information OP_in (i.e., a gray level corresponding to the input data DT_in) may be different from the reference gray level GL_ref corresponding to the reference look-up table LUT_ref.

To compensate the MURA region included in the input optical information OP_in, the first MURA compensation may be performed based on the reference look-up table LUT_ref. The first compensated data DT_1 may be generated as a result of the first MURA compensation, and first compensation optical information OP_1 corresponding to the first compensated data DT_1 may be obtained. In this case, even though the first MURA compensation is performed based on the reference look-up table LUT_ref, the first compensation optical information OP_1 may include the MURA region. That is there is a region where the MURA is not normally compensated.

In this case, the display driving circuit 100 according to an embodiment of the disclosure may generate the final data DT_fin by generating the supplementary compensation value CV_sp based on the input data DT_in, the thresholds THs, and the reference look-up table LUT_ref and performing the second MURA compensation on the first compensated data DT_1 based on the generated supplementary compensation value CV_sp. Final optical information OP_fin may correspond to the final data DT_fin. In this case, as illustrated in FIG. 10, the luminance imbalance (i.e., the MURA) may not occur at the final optical information OP_fin. That is, as described above, because the second MURA compensation based on the supplementary compensation value CV_sp is performed on the MURA region existing even after the first MURA compensation, the luminance imbalance may not occur at the final optical information OP_fin.

Figure 11:
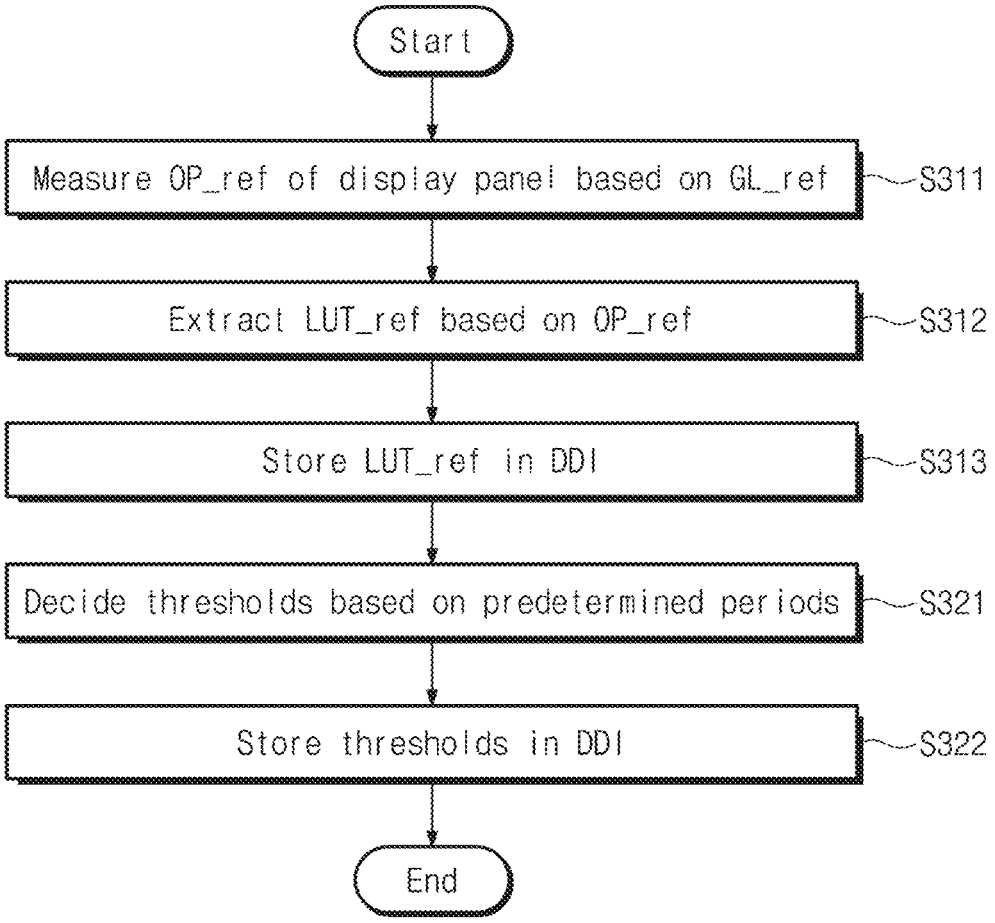
FIG. 11 is a flowchart illustrating an operation of an optical-based MURA inspection device of FIG. 4.

FIG. 11 is a flowchart illustrating an operation of an optical-based MURA inspection device of FIG. 4. For convenience of description, additional description associated with the components described above will be omitted to avoid redundancy. Referring to FIGS. 4 and 11, the optical-based MURA inspection device 10 may perform operation S311 to operation S313. Operation S311 to operation S313 are similar to operation S111 to operation S113 of FIG. 4, and thus, additional description will be omitted to avoid redundancy.

In operation S321, the optical-based MURA inspection device 10 may decide thresholds based on periods determined in advance. For example, according to the flowchart of FIG. 5, the optical-based MURA inspection device 10 may obtain the supplementary optical information OP_sp through the iterative operation performed for each of a plurality of gray levels and may decide the thresholds THs based on the supplementary optical information OP_sp. In contrast, according to the flowchart of FIG. 11, the optical-based MURA inspection device 10 may omit the operation of obtaining the supplementary optical information OP_sp and may decide the thresholds THs based on preset periods. In an exemplary embodiment, the preset periods determined in advance may be periods that are determined in advance through the MURA inspection operation performed on other display panels. Alternatively, the preset periods may have the same lengths.

In operation S322, the optical-based MURA inspection device 10 may store the decided threshold THs in the display driving circuit 100. In an exemplary embodiment, the optical-based MURA inspection device 10 may store information about the coefficient coef (referring to FIGS. 9A and 9B) corresponding to each of the plurality of periods in the display driving circuit 100.

Figure 12:
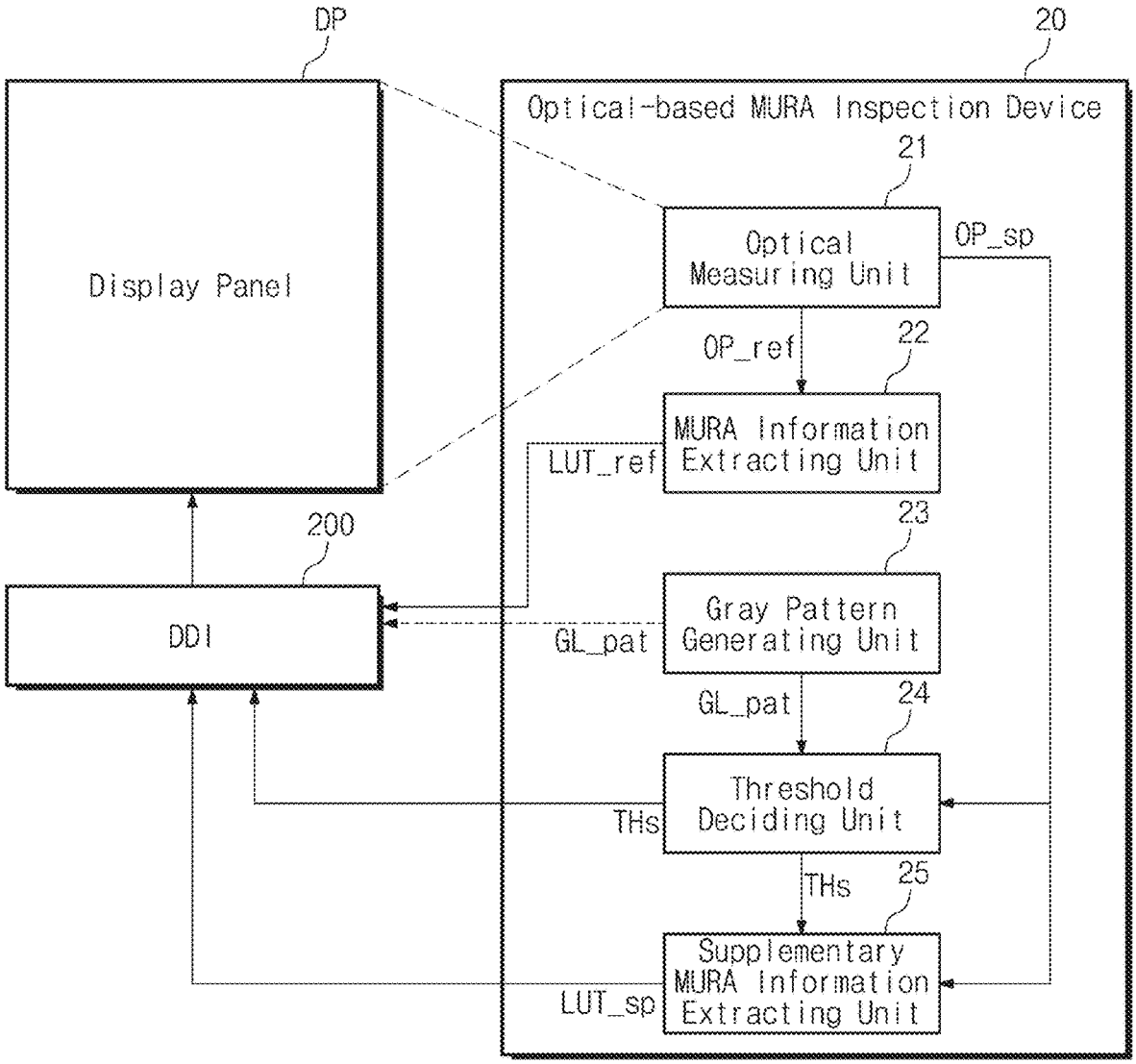
FIG. 12 is a block diagram illustrating a MURA preventing system of a display panel according to an embodiment of the disclosure.

FIG. 12 is a block diagram illustrating a MURA preventing system of a display panel according to an embodiment of the disclosure. For convenience of description, additional description associated with the components described above will be omitted to avoid redundancy. Referring to FIG. 12, an optical-based MURA inspection device 20 may include an optical measuring unit 21, a MURA information extracting unit 22, a gray pattern generating unit 23, a threshold deciding unit 24, and a supplementary MURA information extracting unit 25.

The optical-based MURA inspection device 20 may measure the reference optical information OP_ref from the display panel DP, which is controlled based on the reference gray level GL_ref, and may extract the reference look-up table LUT_ref based on the reference optical information OP_ref thus measured. The reference look-up table LUT_ref thus extracted may be stored in a display driving circuit (DDI) 200. The optical-based MURA inspection device 20 may generate the gray level pattern GL_pat, and the display driving circuit 200 may control the display panel DP based on the gray level pattern GL_pat. The optical-based MURA inspection device 20 may measure the supplementary optical information OP_sp received from the display panel DP, which is controlled based on the gray level pattern GL_pat, the threshold deciding unit 24 may decide the thresholds THs based on the supplementary optical information OP_sp, and the decided thresholds THs may be stored in the display driving circuit 200. The optical measuring unit 21, the MURA information extracting unit 22, the gray pattern generating unit 23, and the threshold deciding unit 24, and the operations thereof are described above, and thus, additional description will be omitted to avoid redundancy.

In an exemplary embodiment, the optical-based MURA inspection device 20 of FIG. 12 may further include the supplementary MURA information extracting unit 25. The supplementary MURA information extracting unit 25 may extract a supplementary look-up table LUT_sp based on the supplementary optical information OP_sp. In an exemplary embodiment, the supplementary look-up table LUT_sp may include information of the supplementary compensation value CV_sp for each of a plurality of pixels of the display panel DP. In an exemplary embodiment, the supplementary look-up table LUT_sp may include information about the supplementary compensation value CV_sp for each of a plurality of gray level periods. The supplementary look-up table LUT_sp may be stored in the display driving circuit 200.

In an exemplary embodiment, the supplementary compensation values CV_sp included in the supplementary look-up table LUT_sp may be determined in advance based on the method described with reference to FIGS. 1 to 11. That is, the display driving circuit 200 may select the supplementary compensation value CV_sp from the supplementary look-up table LUT_sp depending on a gray level period of the input data DT_in without separately calculating the supplementary look-up table LUT_sp and may perform the second MURA compensation based on the selected supplementary compensation value CV_sp.

Figure 13:
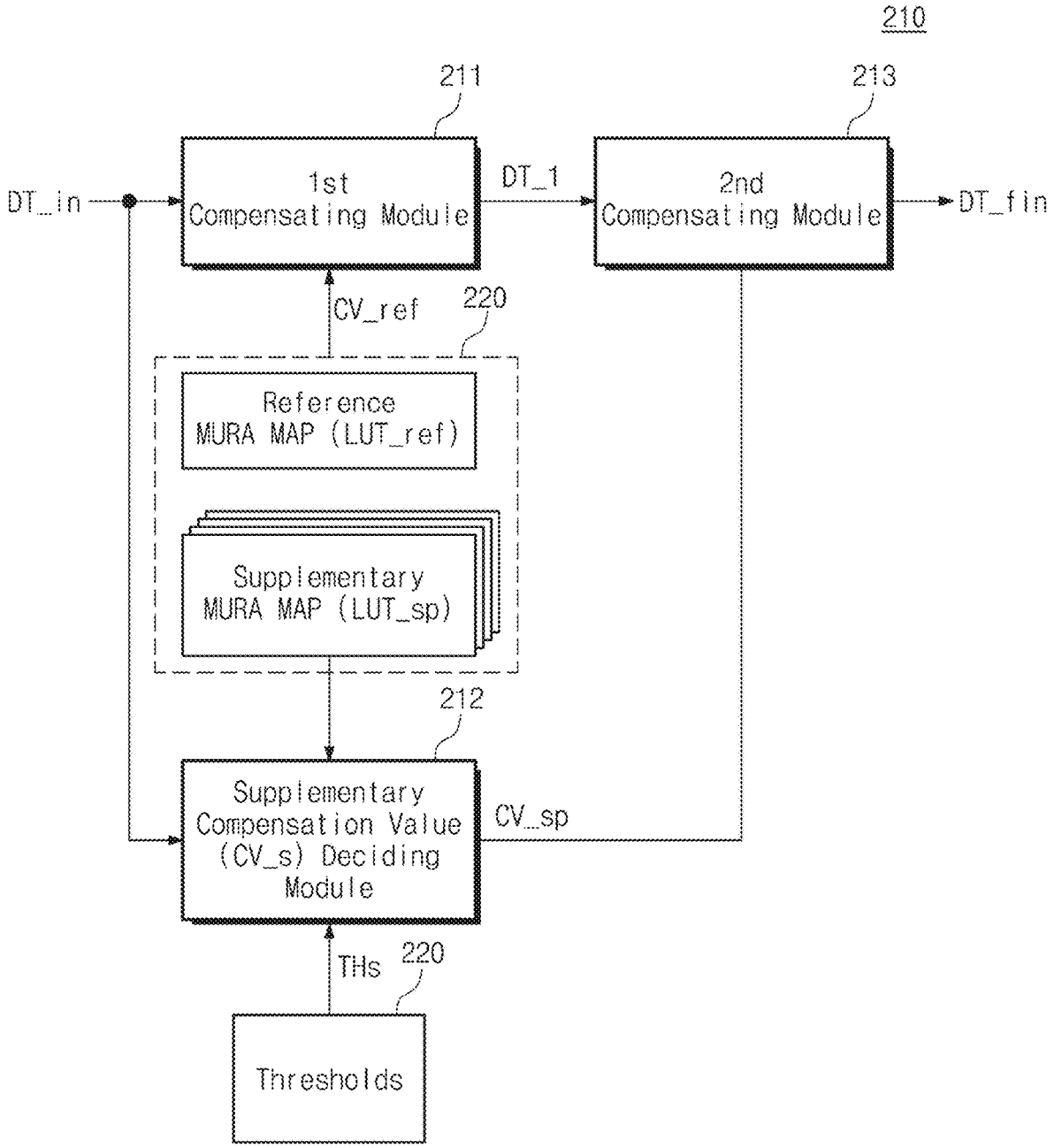
FIG. 13 is a block diagram illustrating a MURA compensation circuit included in a display driving circuit of FIG. 12.
Figure 14A:
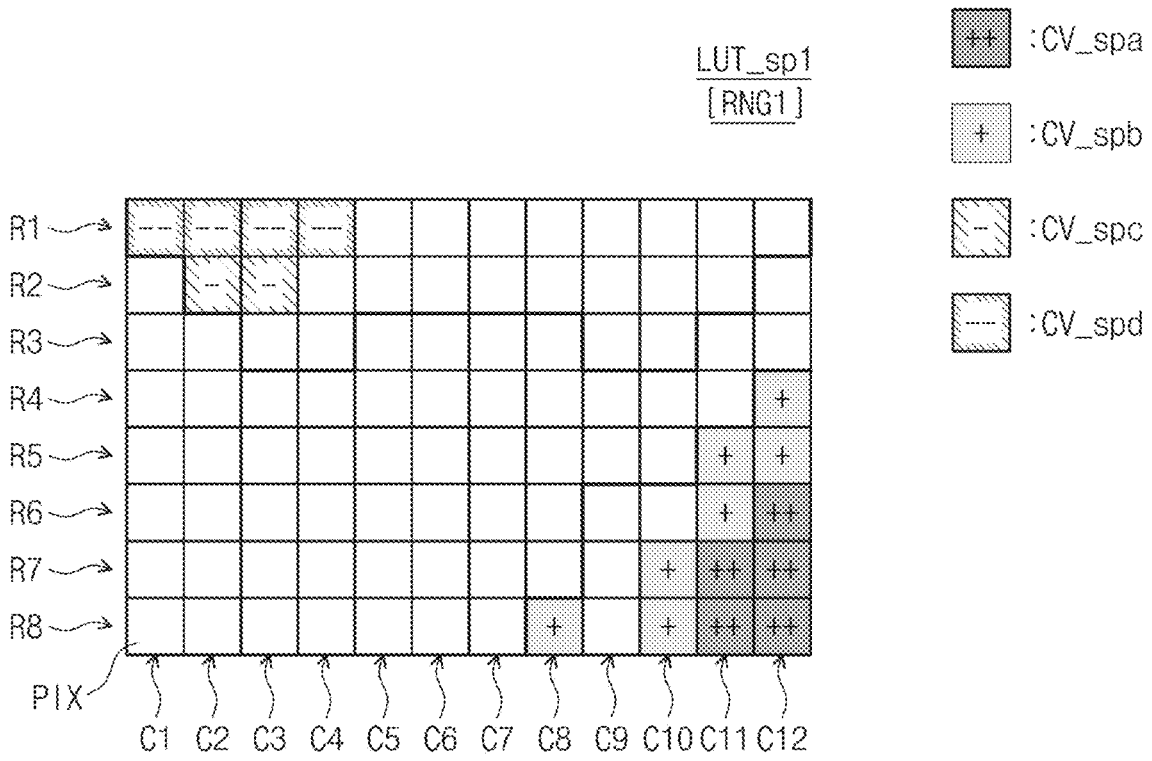
FIGS. 14A and 14B are diagrams illustrating configurations of a supplementary look-up table of FIG. 13.
Figure 14B:
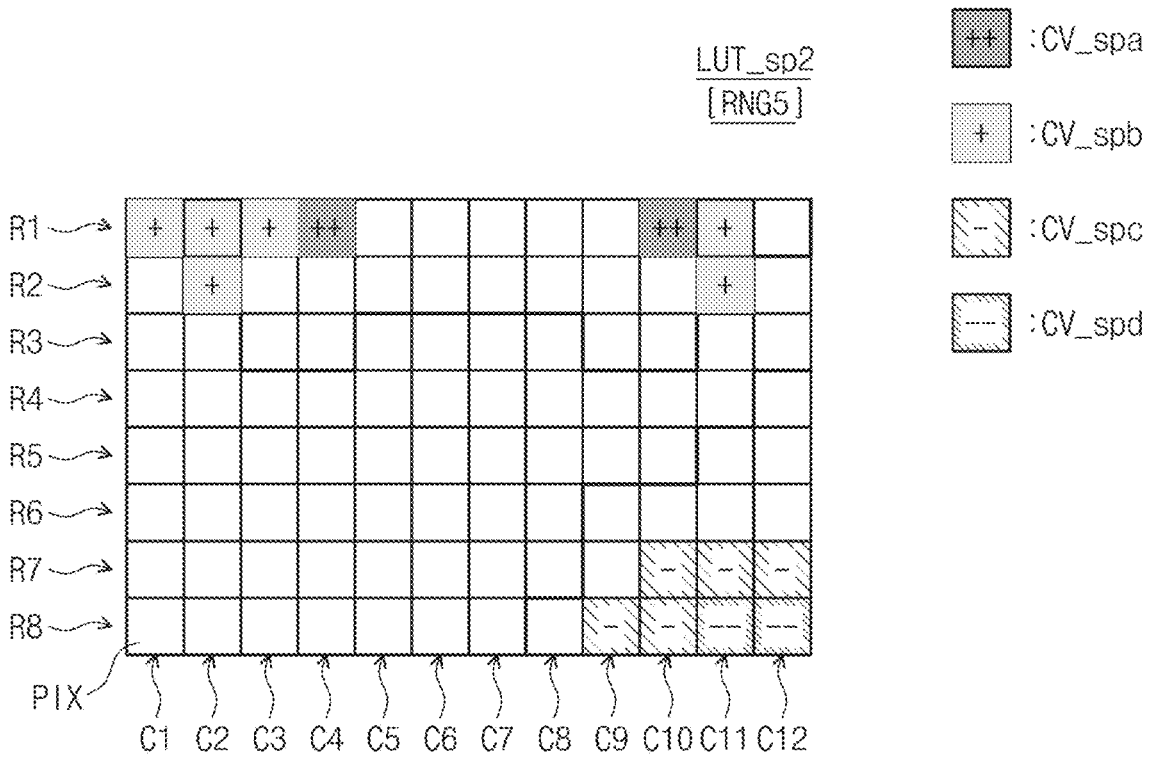

FIG. 13 is a block diagram illustrating a MURA compensation circuit included in a display driving circuit of FIG. 12. FIGS. 14A and 14B are diagrams illustrating configurations of a supplementary look-up table of FIG. 13. Referring to FIGS. 12, 13, 14A, and 14B, a MURA compensation circuit 210 of the display driving circuit 200 may include a first compensating module 211, a supplementary compensation value deciding module 212, and a second compensating module 213. The reference look-up table LUT_ref, the supplementary look-up table LUT_sp, and the thresholds THs may be included in a storage circuit 220 of the display driving circuit 200. The first compensating module 211 and the second compensating module 213 are similar to those described with reference to FIG. 8, and thus, additional description will be omitted to avoid redundancy.

The supplementary compensation value deciding module 212 may decide the supplementary compensation value CV_sp from the supplementary look-up table LUT_sp, based on the input data DT_in and the thresholds THs. For example, the supplementary look-up table LUT_sp may include the supplementary compensation value CV_sp for each of a plurality of gray level periods. In detail, as illustrated in FIGS. 14A and 14B, supplementary look-up tables may include first and second supplementary look-up tables LUT_sp1 and LUT_sp2.

The first supplementary look-up table LUT_sp1 may include a supplementary compensation value corresponding to the first gray level period RNG1 (refer to FIG. 6A), for each of the plurality of pixels PIX. For example, in the case where a gray level of the input data DT_in is included in the first period RNG1, the first supplementary look-up table LUT_sp1 may include information about a supplementary compensation value to be used in the second MURA compensation.

In this case, supplementary compensation values constituting the first supplementary look-up table LUT_sp1 may be different from reference correction values of the reference look-up table LUT_ref (refer to FIG. 2C). That is, as illustrated in FIG. 2C, the first MURA MURA1 and the second MURA MURA2 may occur in the display panel DP at the reference gray level GL_ref, and the reference look-up table LUT_ref may include information about reference compensation values CV_ref1 to CV_ref4 that are applied to regions where the first MURA MURA1 and the second MURA MURA2 occur.

In contrast, the first supplementary look-up table LUT_sp1 may include supplementary compensation values CV_spa to CV_spd corresponding to regions of MURAs that occur at gray levels (different from the reference gray level GL_ref) included in the first period RNG1 after the first MURA compensation. That is, in the reference look-up table LUT_ref, even though the reference compensation value CV_ref for pixels at the first row R1 and the first and twelfth columns C1 and C12 is identically the first reference compensation value CV_ref1, at the gray levels included in the first period RGN1, luminance differences of the pixels at the first row R1 and the first and twelfth columns C1 and C12 may be different after the first MURA compensation is performed. That is, after the first MURA compensation based on the reference look-up table LUT_ref is performed, the pixel at the first row R1 and the first column C1 may have a luminance difference corresponding to the fourth supplementary compensation value CV_spd and a luminance difference may not occur at the pixel at the first row R1 and the twelfth column C12.

For example, in the case where the input data DT_in has a gray level included in the first period RNG1, the first supplementary look-up table LUT_sp1 may include information about a supplementary compensation value to be used in the second MURA compensation, for each pixel.

Likewise, as illustrated in FIG. 14B, the second supplementary look-up table LUT_sp2 may include the supplementary compensation values CV_spa to CV_spd corresponding to the fifth gray level period RNG5 (refer to FIG. 6A), for each of the plurality of pixels PIX. A configuration of the second supplementary look-up table LUT_sp2 is similar to the configuration of the first supplementary look-up table LUT_sp1 described above except that gray level periods are different and the corresponding supplementary compensation values are different.

In an exemplary embodiment, the supplementary look-up tables LUT_sp1 and LUT_sp2 may be stored in the storage circuit 220 or may be calculated based on the reference look-up table LUT_ref stored in the storage circuit 220. That is, the storage circuit 220 may store only the reference look-up table LUT_ref; in this case, a separate calculating module may calculate the supplementary look-up tables LUT_sp1 and LUT_sp2 based on the reference look-up table LUT_ref. In this case, the separate calculating module may generate or calculate the supplementary look-up table LUT_sp based on the reference look-up table LUT_ref and a variety of information such as coefficient information, distance information, or period information, as described above.

As described above, the display driving circuit 200 may include at least one supplementary look-up table LUT_sp including the supplementary compensation value CV_sp for each of a plurality of gray levels or for each of a plurality of gray level periods. In this case, the display driving circuit 200 may be configured to select the corresponding supplementary compensation value from the supplementary look-up table LUT_sp without separately calculating the supplementary compensation value CV_sp for the second MURA compensation. In an exemplary embodiment, the supplementary look-up table LUT_sp may be decided by pre-inspection of the optical-based MURA inspection device 20.

Figure 15:
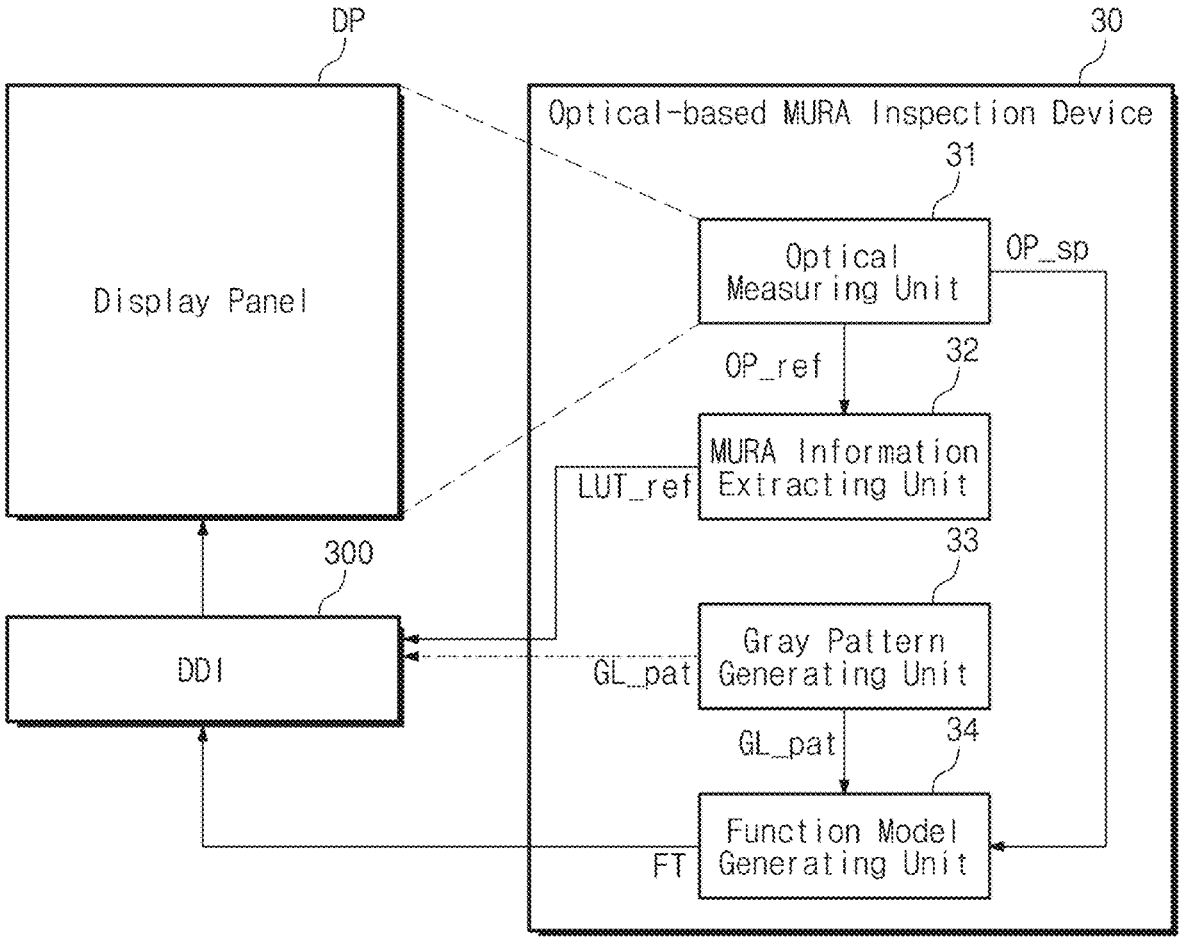
FIG. 15 is a block diagram illustrating a MURA preventing system of a display panel according to an embodiment of the disclosure.
Figure 16:
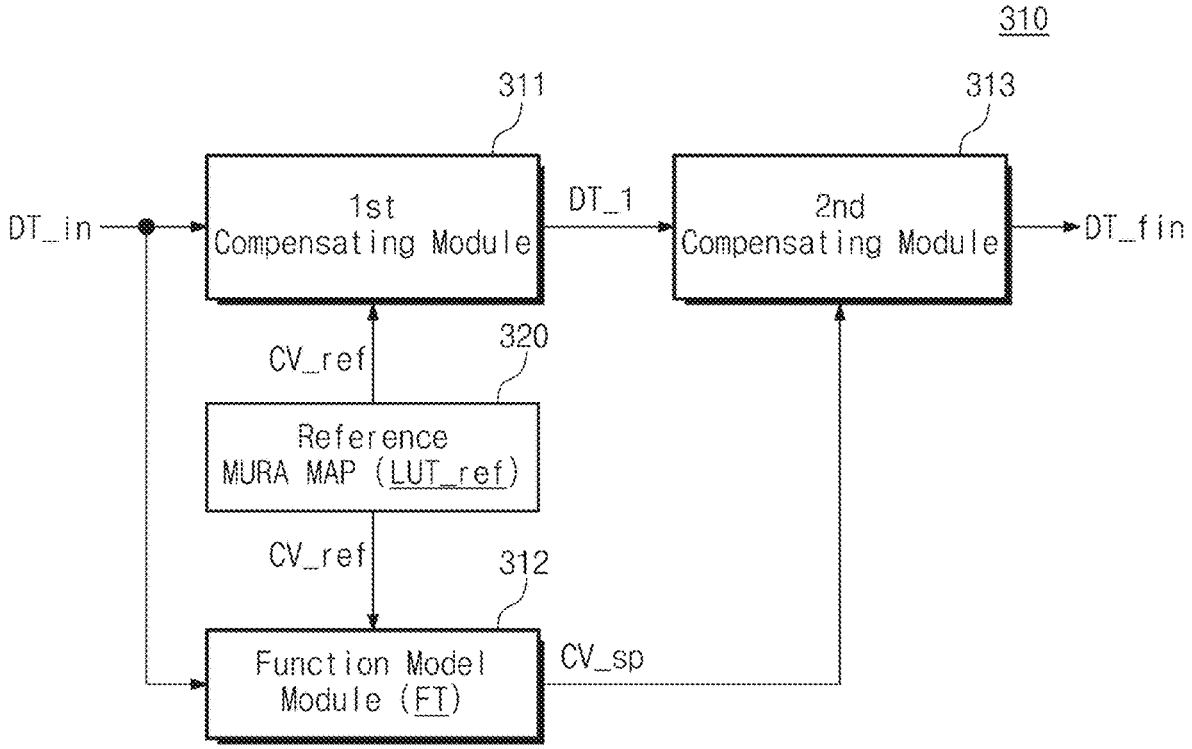
FIG. 16 is a block diagram illustrating a display driving circuit of FIG. 15.

FIG. 15 is a block diagram illustrating a MURA preventing system of a display panel according to an embodiment of the disclosure. FIG. 16 is a block diagram illustrating a display driving circuit of FIG. 15. Referring to FIG. 15, an optical-based MURA inspection device 30 may include an optical measuring unit 31, a MURA information extracting unit 32, a gray pattern generating unit 33, and a function model generating unit 34. The optical-based MURA inspection device 30 may measure the reference optical information OP_ref from the display panel DP, which is controlled based on the reference gray level GL_ref, and may extract the reference look-up table LUT_ref based on the reference optical information OP_ref thus measured. The reference look-up table LUT_ref thus extracted may be stored in a display driving circuit (DDI) 300. The optical-based MURA inspection device 30 may generate the gray level pattern GL_pat, and the display driving circuit 300 may control the display panel DP based on the gray level pattern GL_pat. The optical-based MURA inspection device 30 may measure the supplementary optical information OP_sp from the display panel DP controlled based on the gray level pattern GL_pat. The optical measuring unit 31, the MURA information extracting unit 32, and the gray pattern generating unit 33 are described above, and thus, additional description will be omitted to avoid redundancy.

The function model generating unit 34 may generate a function model FT based on the supplementary optical information OP_sp. For example, the supplementary optical information OP_sp may have a characteristic corresponding to the third curve (i.e., first MURA-compensated data obtained by performing the first MURA compensation based on the reference look-up table LUT_ref) described with reference to FIG. 6A. The function model generating unit 34 may generate, learn, extract, or model a function model having the characteristic of the third curve of FIG. 6A, based on the supplementary optical information OP_sp. That is, the function model FT may be configured to output the characteristic (i.e., first MURA-compensated data obtained by performing the first MURA compensation based on the reference look-up table LUT_ref) of the third curve of FIG. 6A depending on a gray level of the input data DT_in.

Information about the function model FT may be stored in the display driving circuit 300. For example, as illustrated in FIG. 16, a MURA compensation circuit 310 of the display driving circuit 300 may include a first compensating module 311, a function model module 312, and a second compensating module 313. The first compensating module 311 and the second compensating module 313 are described above, and thus, additional description will be omitted to avoid redundancy.

The function model module 312 may include the function model FT generated by the function model generating unit 34 of the optical-based MURA inspection device 30. The function model module 312 may be configured to output the supplementary compensation value CV_sp based on the input data DT_in and the reference correction value CV_ref of the reference look-up table LUT_ref. For example, as described above, the function model FT may be a model obtained by modeling gray level-luminance information after the first MURA compensation is performed. That is, first compensated data DT_in corresponding to the input data DT_in may be decided by the function model FT, and thus, the supplementary compensation value CV_sp to be used in the second MURA compensation may be decided. That is, the MURA compensation circuit 310 of the display driving circuit 300 may decide the supplementary compensation value CV_sp continuously, linearly, or non-linearly through the function model FT, instead of determining a gray level period of the input data DT_in.

Figure 17:
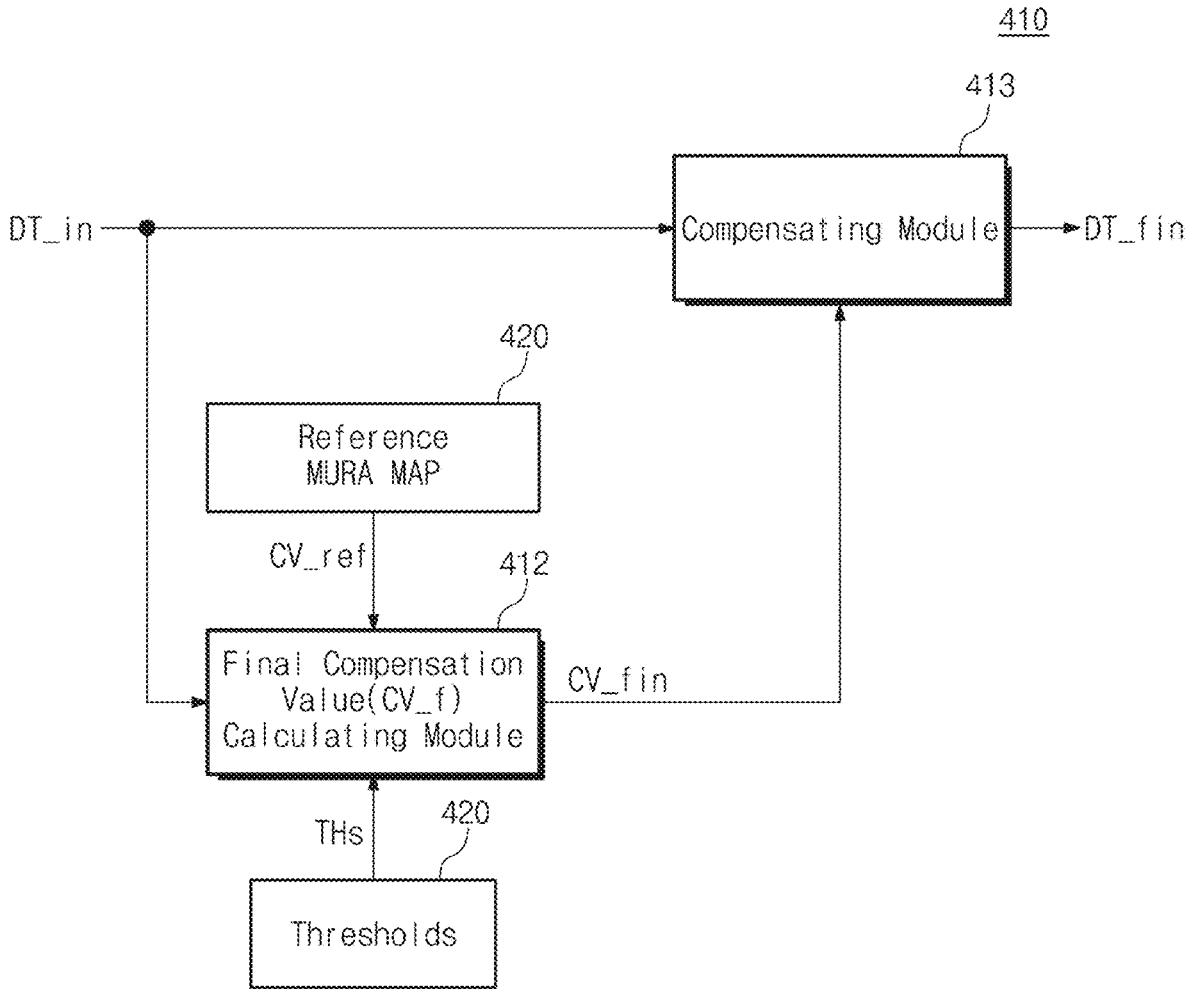
FIG. 17 is a block diagram illustrating a MURA compensation circuit of a display driving circuit according to an embodiment of the disclosure.
Figure 18:
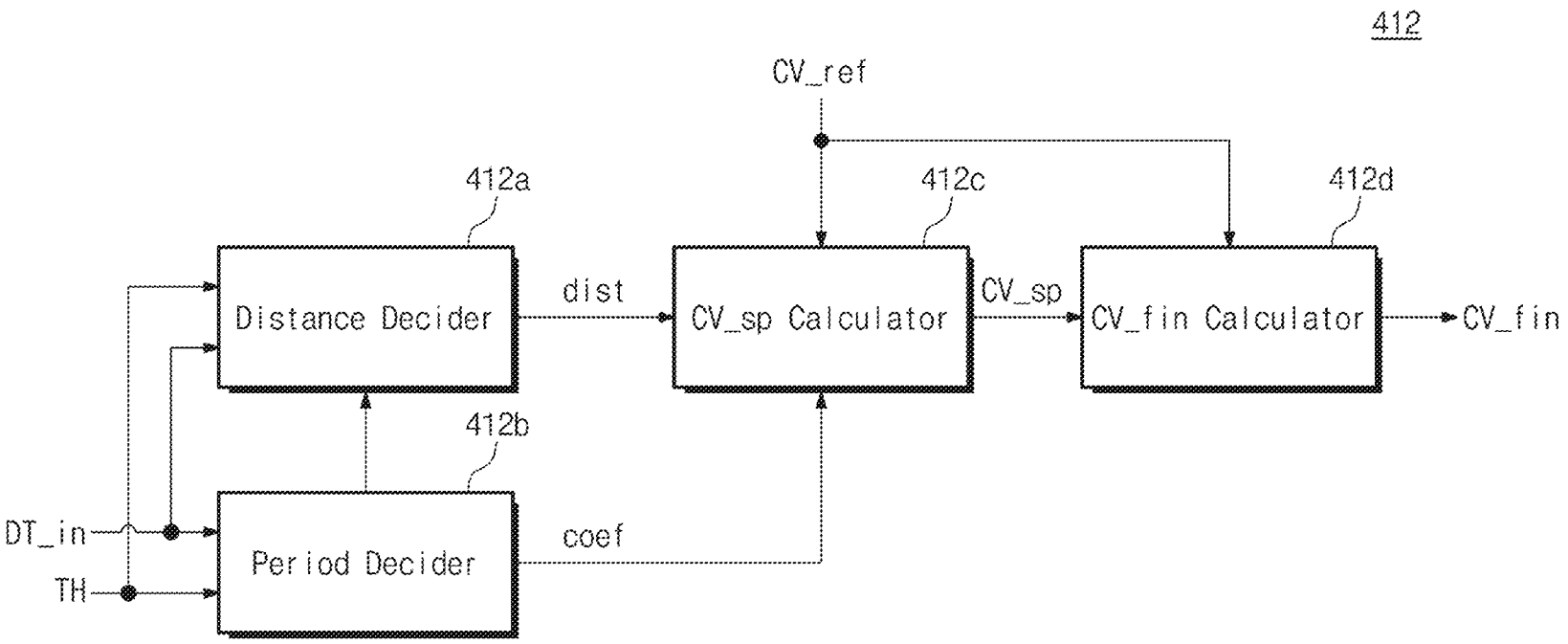
FIG. 18 is a block diagram illustrating a final compensation value calculating module of FIG. 17.

FIG. 17 is a block diagram illustrating a MURA compensation circuit of a display driving circuit according to an embodiment of the disclosure. FIG. 18 is a block diagram illustrating a final compensation value calculating module of FIG. 17. For convenience of description, additional description associated with the components described above will be omitted to avoid redundancy.

Referring to FIGS. 17 and 18, a MURA compensation circuit 410 may include a final compensation value (CV_f) calculating module 412 and a compensating module 413. The reference look-up table LUT_ref and the thresholds THs may be included in a storage circuit 420. The reference look-up table LUT_ref and the thresholds THs may be stored in the storage circuit 420 in advance by an inspection operation of an optical-based MURA inspection device, based on the method described with reference to FIGS. 1 to 11.

The compensating module 413 may perform the second MURA compensation operation on the input data DT_in, based on a final compensation value CV_fin from the final compensation value calculating module 412, to output the final data DT_fin. The description is given in the above embodiments as a MURA compensation circuit performs the first MURA compensation and the second MURA compensation. However, in the embodiment of FIG. 17, the MURA compensation circuit 410 may perform MURA compensation once. In this case, the MURA compensation circuit 410 may perform the MURA compensation based on the final compensation value CV_fin re-calculated or re-processed according to a gray level period of the input data DT_in, instead of the reference correction value CV_ref.

For example, the final compensation value calculating module 412 may output the final compensation value CV_fin based on the reference correction value CV_ref of the reference look-up table LUT_ref and the thresholds THs. In detail, as illustrated in FIG. 18, the final compensation value calculating module 412 may include a distance decider 412*a*, a period decider 412*b*, a supplementary compensation value calculator 412*c*, and a final compensation value calculator 412*d*. The distance decider 412*a* may decide the distance information dist based on the input data DT_in and the thresholds THs, the period decider 412*b* may decide the coefficient coef based on the input data DT_in and the thresholds THs, and the supplementary compensation value calculator 412*c* may decide the supplementary compensation value CV_sp based on the distance information dist, the coefficient coef, and the reference compensation value CV_ref. The distance decider 412*a*, the period decider 412*b*, and the supplementary compensation value calculator 412*c* are described above, and thus, additional description will be omitted to avoid redundancy.

The final compensation value calculator 412*d* may combine the supplementary compensation value CV_sp and the reference correction value CV_ref to generate the final compensation value CV_fin. That is, the final compensation value CV_fin may include information about the supplementary compensation value CV_sp and the reference correction value CV_ref. As the MURA compensation is performed on the input data DT_in by using the final compensation value CV_fin, the effects of the first MURA compensation and the second MURA compensation may identically appear.

Although not illustrated in drawings, the period decider 412*b* or the final compensation value calculator 412*d* may use the gamma value GV decided by the external device when calculating the coefficient coef or the final compensation value CV_fin. This is similar to the above description, and thus, additional description will be omitted to avoid redundancy.

As described above, a display driving circuit according to an embodiment of the disclosure may calculate a supplementary compensation value to be used in the second MURA compensation depending on a gray level period of input data. As the display driving circuit performs the second MURA compensation by using the supplementary compensation value, the display driving circuit may normally compensate/remove MURAs (i.e., regions where strong compensation or weak compensation occurs) not normally compensated in the first MURA compensation by simply using a reference look-up table. Accordingly, the luminance imbalance may be prevented at a plurality of gray levels expressible by the display panel DP.

Figure 19:
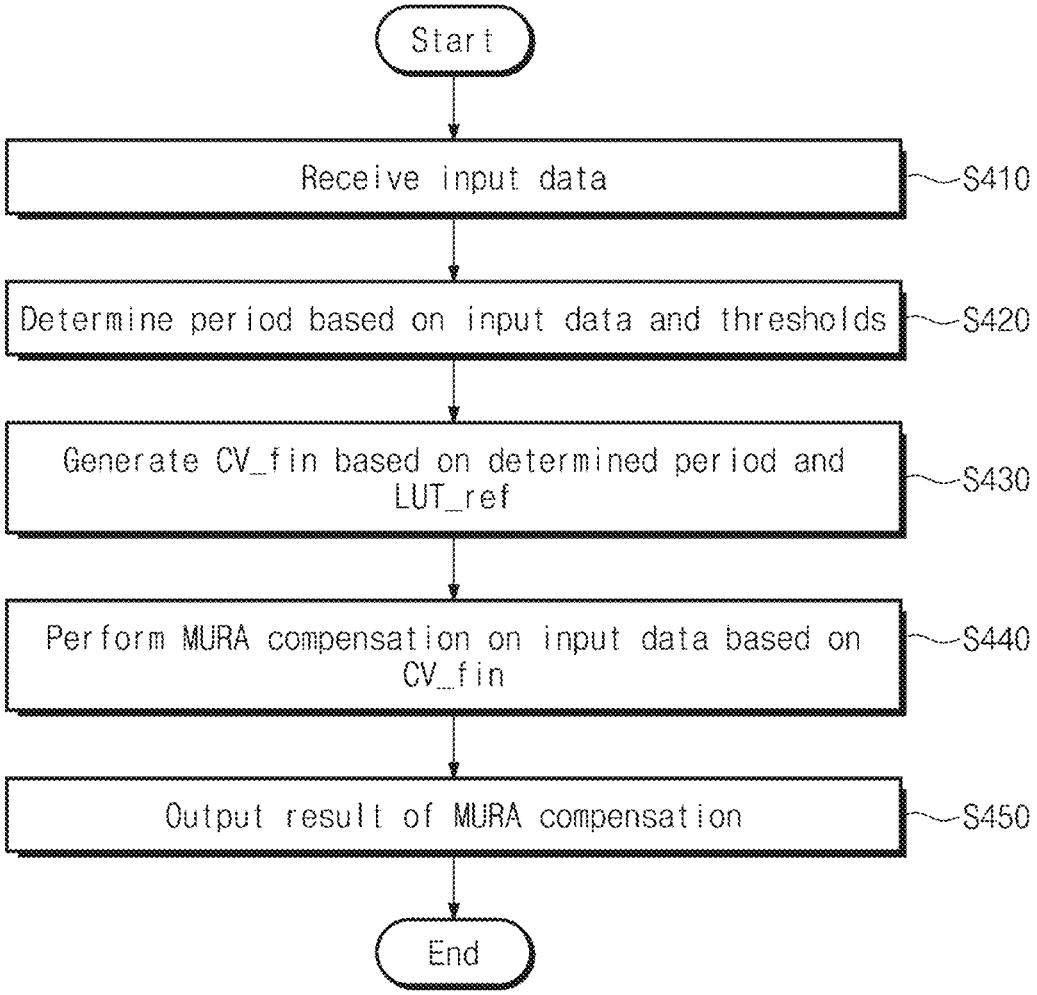
FIG. 19 is a flowchart illustrating an operation of a MURA compensation circuit of a display driving circuit of FIG. 17.

FIG. 19 is a flowchart illustrating an operation of a MURA compensation circuit of a display driving circuit of FIG. 17. For convenience of description, additional description associated with the components described above will be omitted to avoid redundancy.

Referring to FIGS. 17 and 19, in operation S410, the MURA compensation circuit 410 may receive input data.

In operation S420, the MURA compensation circuit 410 may determine a gray level period corresponding to the input data based on the input data and the thresholds THs.

In operation S430, the MURA compensation circuit 410 may calculate the final compensation value CV_fin based on the determined gray level period and the reference look-up table LUT_ref. For example, the MURA compensation circuit 410 may calculate the final compensation value CV_fin by using a different coefficient for each gray level period corresponding to the gray level of the input data, as described with reference to FIGS. 17 and 18. In this case, there may be calculated a compensation value that is more accurate than a compensation value (e.g., a first compensation value) calculated by simply using the reference look-up table LUT_ref.

In operation S440, the MURA compensation circuit 410 may perform the MURA compensation on the input data based on the final compensation value CV_fin. In operation S450, the MURA compensation circuit 410 may output a result of the MURA compensation (i.e., compensation data).

As described above, instead of calculating a compensation value through a linear calculation simply based on the reference look-up table LUT_ref, the MURA compensation circuit 410 according to an embodiment of the disclosure may determine a gray level period corresponding to a gray level of input data based on the thresholds THs determined in advance and may calculate the final compensation value CV_fin by using a different coefficient depending on the determined gray level period (i.e., may calculate a compensation value through a non-linear calculation). Accordingly, the luminance imbalance may be prevented at a plurality of gray levels expressible by the display panel DP.

Figure 20:
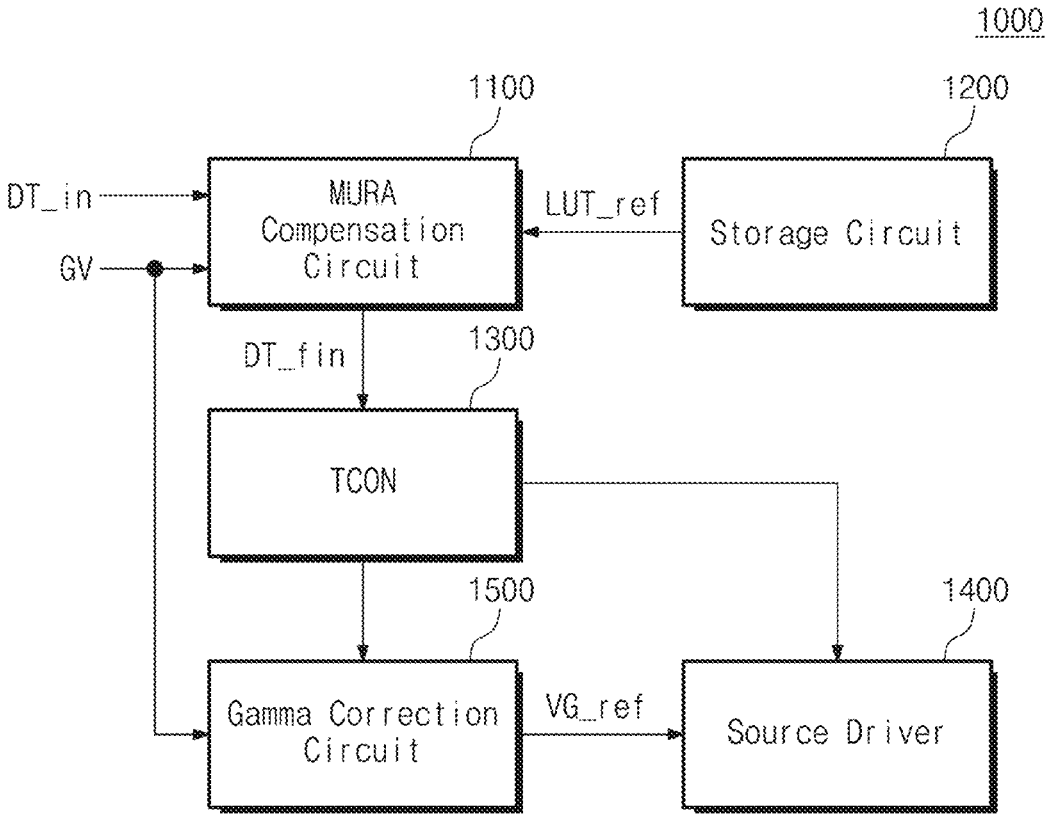
FIG. 20 is a block diagram illustrating a display driving circuit according to an embodiment of the disclosure.

FIG. 20 is a block diagram illustrating a display driving circuit according to an embodiment of the disclosure. Referring to FIG. 20, a display driving circuit 1000 may include a MURA compensation circuit 1100, a storage circuit 1200, a timing controller (TCON) 1300, a source driver 1400, and a gamma correction circuit 1500. The MURA compensation circuit 1100 may be the MURA compensation circuit described with reference to FIGS. 1 to 18 or may operate based on the operation method described with reference to FIGS. 1 to 18. The storage circuit 1200 may be configured to store the reference look-up table LUT_ref, the thresholds THs, the supplementary look-up table LUT_sp, the function model FT, etc. generated by the optical-based MURA inspection device 10, 20, or 30, as described with reference to FIGS. 1 to 18. The MURA compensation circuit 1100, the storage circuit 1200, the timing controller 1300, and the source driver 1400 are described above, and thus, additional description will be omitted to avoid redundancy.

The gamma correction circuit 1500 of the display driving circuit 1000 may be configured to correct gamma characteristics of gray levels expressible by the display panel DP (refer to FIG. 1), that is, to perform gamma correction. For example, luminance of the same gray level may be differently expressed depending on the gamma value GV. The gamma correction circuit 1500 may generate a gamma reference voltage VG_ref based on the gamma value GV. The source driver 1400 may control the display panel DP, based on the gamma reference voltage VG_ref from the gamma correction circuit 1500.

In an exemplary embodiment, as described above, the MURA compensation circuit 410 may use the gamma value GV when performing the first MURA compensation or the second MURA compensation, but the gamma correction according to the gamma value GV may be performed by the gamma correction circuit 1500 after the MURA compensation circuit 1100. In an exemplary embodiment, the gamma correction may be in advance performed through a separate module in front of the MURA compensation circuit 1100, depending on a way to implement the display driving circuit 1000.

Figure 21:
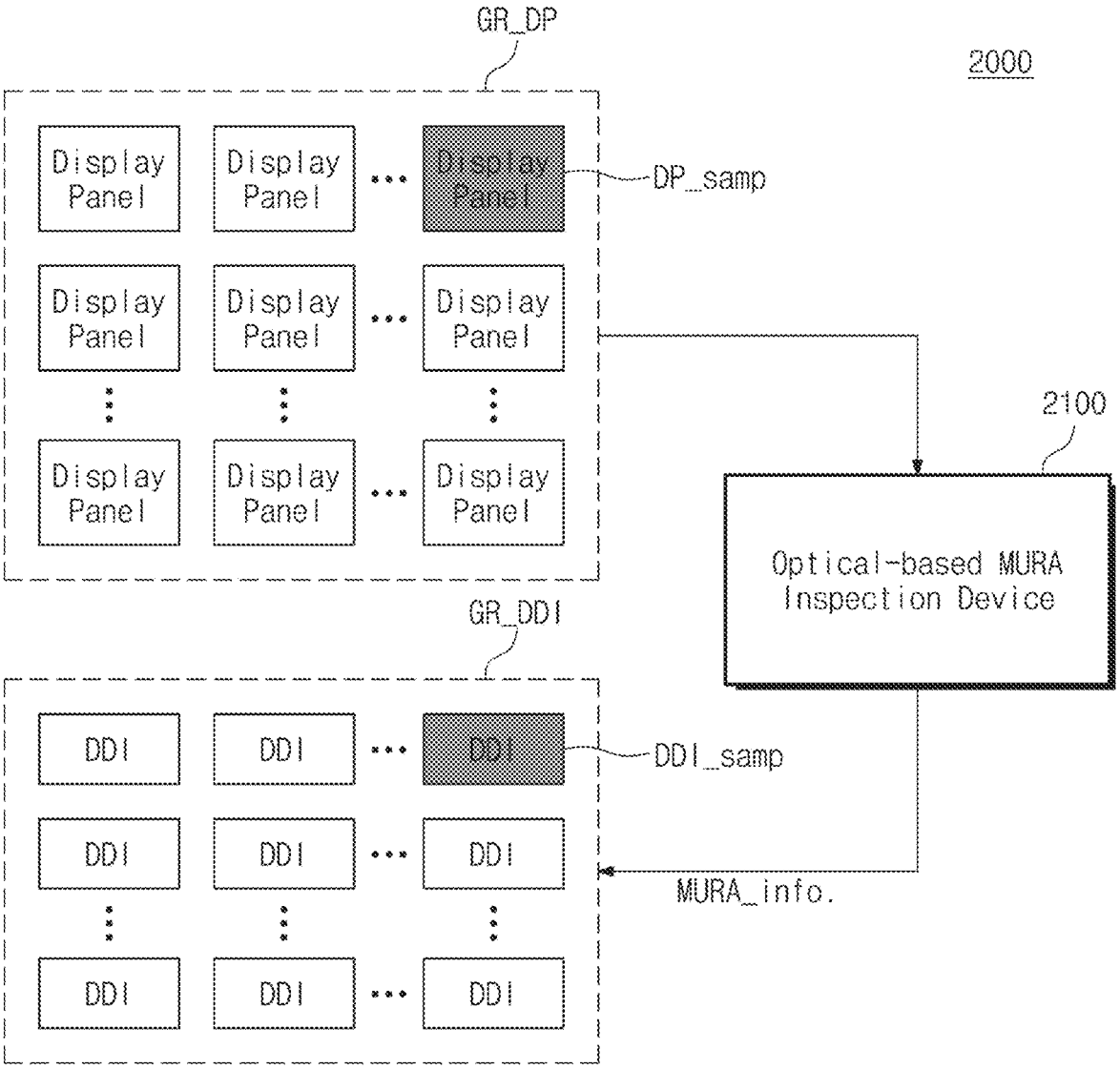
FIG. 21 is a diagram for describing an operation of an optical-based MURA inspection device according to an embodiment of the disclosure.

FIG. 21 is a diagram for describing an operation of an optical-based MURA inspection device according to an embodiment of the disclosure. Referring to FIG. 21, an optical-based MURA inspection system 2000 may include a display panel group GR_DP, a display driving circuit group GR_DDI, and an optical-based MURA inspection device 2100. One display panel group GR_DP may include a plurality of display panels, and one display driving circuit group GR_DDI may include a plurality of display driving circuits.

A plurality of display devices DPD may be implemented by allowing the plurality of display panels included in the display panel group GR_DP to respectively correspond to the plurality of display driving circuits included in the display driving circuit group GR_DDI or allowing the plurality of display panels and the plurality of display driving circuits to be connected with each other in a one-to-one correspondence.

In each of the plurality of display devices DPD, the optical-based MURA inspection device 20 may generate the reference look-up tables LUT_ref, the thresholds THs, the supplementary look-up tables LUT_sp, or the function model FT based on the operation method described with reference to FIGS. 1 to 20 and may store the generated information in the corresponding display driving circuit.

In an exemplary embodiment, the plurality of display panels included in the display panel group GR_DP may be generated in the same process line, and the plurality of display driving circuits included in the display driving circuit group GR_DDI may be manufactured in the same process line. That is, display panels or display driving circuits included in the same group may have the same physical/electrical characteristics. This means that MURA patterns are similar.

As such, to simplify a MURA inspection process, with regard to a sample display panel DP_samp of the display panels of the display panel group GR_DP and a sample display driving circuit DDI_samp of the display driving circuits of the display driving circuit group GR_DDI, the optical-based MURA inspection device 2100 may generate, as MURA_info, the reference look-up table LUT_ref, the thresholds THs, the supplementary look-up tables LUT_sp, or the function model FT based on the operation method described with reference to FIGS. 1 to 20 and may store the generated information in display driving circuits included in the same group. Each of the display driving circuits may perform the operation described with reference to FIGS. 1 to 20 based on the stored information.

Figure 22:
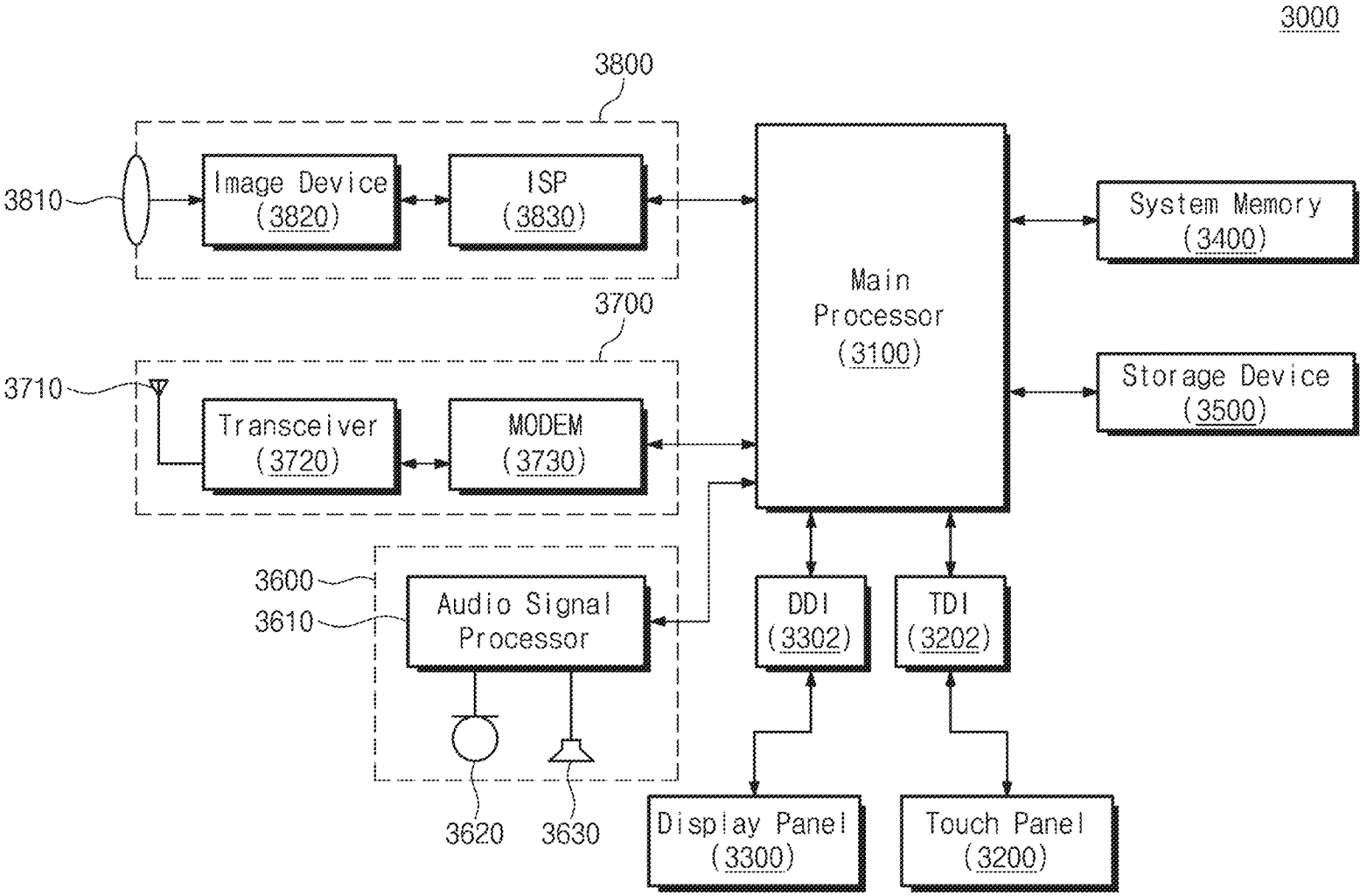
FIG. 22 is a block diagram illustrating an electronic device according to the disclosure.

FIG. 22 is a block diagram illustrating an electronic device according to the disclosure. Referring to FIG. 22, an electronic device 3000 may include a main processor 3100, a touch panel 3200, a touch driving circuit (TDI) 3202, a display panel 3300, a display driving circuit (DDI) 3302, a system memory 3400, a storage device 3500, an audio processor 3600, a communication block 3700, an image processor 3800. In an exemplary embodiment, the electronic device 3000 may be one of various electronic devices such as a portable communication terminal, a personal digital assistant (PDA), a portable media player (PMP), a digital camera, a smartphone, a tablet computer, a laptop computer, and a wearable device.

The main processor 3100 may control overall operations of the electronic device 3000. The main processor 3100 may control/manage operations of the components of the electronic device 3000. The main processor 3100 may process various operations for the purpose of operating the electronic device 3000.

The touch panel 3200 may be configured to sense a touch input from a user under control of the touch driving circuit 3202. The display panel 3300 may be configured to display image information under control of the display driving circuit 3302. In an exemplary embodiment, the display driving circuit 3302 may be configured to compensate the MURA occurring at the display panel 3300 based on the method described with reference to FIGS. 1 to 20. Although not illustrated in drawings, the touch panel 3200 and the display panel 3300 may be implemented with one panel, and the touch driving circuit 3202 and the display driving circuit 3302 may be implemented with one integrated circuit.

The system memory 3400 may store data that are used for an operation of the electronic device 3000. For example, the system memory 3400 may include a volatile memory such as a static random access memory (SRAM), a dynamic RAM (DRAM), or a synchronous DRAM (SDRAM), and/or a nonvolatile memory such as a phase-change RAM (PRAM), a magneto-resistive RAM (MRAM), a resistive RAM (ReRAM), or a ferroelectric RAM (FRAM).

The storage device 3500 may store data regardless of whether power is supplied. For example, the storage device 3500 may include at least one of various nonvolatile memories such as a flash memory, a PRAM, an MRAM, a ReRAM, and an FRAM. For example, the storage device 3500 may include an embedded memory and/or a removable memory of the electronic device 3000.

The audio processor 3600 may process an audio signal by using an audio signal processor 3610. The audio processor 3600 may receive an audio input through a microphone 3620 or may provide an audio output through a speaker 3630.

A communication block 3700 may exchange signals with an external device/system through an antenna 3710. A transceiver 3720 and a modulator/demodulator (MODEM) 3730 of the communication block 3700 may process signals exchanged with the external device/system in compliance with at least one of various wireless communication protocols: long term evolution (LTE), worldwide interoperability for microwave access (WiMax), global system for mobile communication (GSM), code division multiple access (CDMA), Bluetooth, near field communication (NFC), wireless fidelity (Wi-Fi), and radio frequency identification (RFID).

The image processor 3800 may receive a light through a lens 3810. An image device 3820 and an image signal processor (ISP) 3830 included in the image processor 3800 may generate image information about an external object, based on a received light.

According to the disclosure, a display driving circuit may perform the first MURA compensation on input data based on a reference look-up table and may perform the second MURA compensation based on a supplementary compensation value corresponding to a gray level period of the input data. As such, the MURA that is not removed in the first MURA compensation performed solely with the reference look-up table may be additionally removed. Accordingly, a display driving circuit configured to provide an image of improved quality, an operation method of the display driving circuit, and an operation method of an optical-based MURA inspection device configured to extract information for removing a MURA of a display panel are provided.

As is traditional in the field, embodiments may be described and illustrated in terms of blocks which carry out a described function or functions. These blocks, which may be referred to herein as units or modules or the like, are physically implemented by analog and/or digital circuits such as logic gates, integrated circuits, microprocessors, microcontrollers, memory circuits, passive electronic components, active electronic components, optical components, hardwired circuits and the like, and may optionally be driven by firmware and/or software. The circuits may, for example, be embodied in one or more semiconductor chips, or on substrate supports such as printed circuit boards and the like. The circuits constituting a block may be implemented by dedicated hardware, or by a processor (e.g., one or more programmed microprocessors and associated circuitry), or by a combination of dedicated hardware to perform some functions of the block and a processor to perform other functions of the block. Each block of the embodiments may be physically separated into two or more interacting and discrete blocks without departing from the scope of the disclosure. Likewise, the blocks of the embodiments may be physically combined into more complex blocks without departing from the scope of the disclosure. An aspect of an embodiment may be achieved through instructions stored within a non-transitory storage medium and executed by a processor.

While the disclosure has been described with reference to exemplary embodiments thereof, it will be apparent to those of ordinary skill in the art that various changes and modifications may be made thereto without departing from the spirit and scope of the disclosure as set forth in the following claims.

What is claimed is:

1. An operation method of a display driving circuit configured to drive a display panel, the method comprising:

receiving input data from an external device;

determining a gray level period corresponding to the input data from among a plurality of gray level periods, based on a plurality of thresholds;

calculating a final compensation value based on the gray level period and a reference look-up table generated based on a reference gray level;

performing MURA compensation on the input data based on the final compensation value to generate final data; and controlling the display panel based on the final data.

2. The method of claim 1, wherein the reference look-up table includes reference compensation values of a plurality of pixels of the display panel, with regard to the reference gray level.

3. The method of claim 1, wherein the plurality of gray level periods are divided based on the plurality of thresholds.

4. The method of claim 3, wherein the plurality of thresholds are decided in advance based on data, which are MURA-compensated, based on the reference look-up table.

5. The method of claim 1, wherein:

when the gray level period is a first gray level period, the final compensation value corresponds to a first value, when the gray level period is a second gray level period different from the first gray level period, the final compensation value corresponds to a second value, and an absolute value of the first value is different from an absolute value of the second value.

6. The method of claim 1, wherein the calculating of the final compensation value based on the gray level period includes:

deciding a coefficient corresponding to the gray level period;

calculating a distance between a gray level of the input data and the reference gray level; and calculating the final compensation value based on the coefficient, the distance, and the reference look-up table.

7. The method of claim 1, wherein when the gray level period is a gray level period in which the reference gray level is included, the final compensation value is equal to a reference compensation value included in the reference look-up table.

8. The method of claim 1, wherein information about the reference look-up table and the thresholds is stored in a storage circuit of the display driving circuit, in an inspecting process of inspecting the display driving circuit and the display panel.

9. The method of claim 8, further comprising:

performing MURA compensation on pattern data, which correspond to a gray level pattern from an optical-based MURA inspection device based on the reference look-up table, in response to the gray level pattern to generate first compensation pattern data, after the reference look-up table is stored in the storage circuit, in the inspecting process; and controlling the display panel based on the first compensation pattern data, in the inspecting process.

10. A display driving circuit configured to drive a display panel, the display driving circuit comprising:

a storage circuit configured to store a plurality of thresholds and a reference look-up table generated based on a reference gray level;

a MURA compensation circuit configured to receive input data from an external device, to decide a gray level period corresponding to the input data from among a plurality of gray level periods, based on the plurality of thresholds, to calculate a final compensation value based on the gray level period and the reference look-up table, and to perform MURA compensation on the input data based on the final compensation value to generate final data;

a source driver configured to drive a plurality of source lines connected with the display panel; and a timing controller configured to control the source driver based on the final data.

11. The display driving circuit of claim 10, wherein the reference look-up table and the plurality of thresholds are stored by an optical-based MURA inspection device, in an inspection process of the display driving circuit.

12. The display driving circuit of claim 10, wherein the plurality of gray level periods are divided based on the plurality of thresholds.

13. The display driving circuit of claim 10, wherein the MURA compensation circuit includes:

a final compensation value calculating module configured to decide the gray level period corresponding to the input data based on the plurality of thresholds and to calculate the final compensation value based on the gray level period and the reference look-up table; and a compensating module configured to perform the MURA compensation on the input data based on the final compensation value to generate the final data.

14. The display driving circuit of claim 13, wherein the final compensation value calculating module includes:

a distance decider configured to decide a distance between the input data and the reference gray level;

a period decider configured to decide a coefficient corresponding to the gray level period of the input data;

a supplementary compensation value calculator configured to calculate a supplementary compensation value based on the coefficient, the distance, and the reference look-up table; and a final compensation value calculator configured to combine information of the supplementary compensation value and the reference look-up table to calculate the final compensation value.

15. The display driving circuit of claim 13, further comprising:

a gamma correction circuit configured to generate a gamma reference voltage based on a gamma value, wherein the source driver is further configured to control the plurality of source lines based on the gamma reference voltage under control of the timing controller.

16. An operation method of an optical-based MURA inspection device configured to extract information to be used to compensate a MURA of a display panel, the method comprising:

measuring reference optical information from the display panel, which is controlled based on a reference gray level;

generating a reference look-up table based on the reference optical information;

storing the reference look-up table in a display driving circuit configured to control the display panel;

generating a gray level pattern based on a plurality of gray levels expressible by the display panel;

measuring supplementary optical information from the display panel, which is controlled based on the gray level pattern;

deciding a plurality of thresholds for determining a plurality of gray level periods based on the gray level pattern and the supplementary optical information; and storing the plurality of thresholds in the display driving circuit.

17. The method of claim 16, wherein:

the display panel is controlled based on first compensation pattern data, and the first compensation pattern data is generated by performing MURA compensation, based on the reference look-up table, on pattern data corresponding to at least one gray level of the plurality of gray levels.

18. The method of claim 17, wherein the deciding of the plurality of thresholds for determining the plurality of gray level periods based on the gray level pattern and the supplementary optical information includes:

detecting a luminance difference after the MURA compensation based on the supplementary optical information, with regard to the at least one gray level;

dividing the plurality of gray levels into the plurality of gray level periods based on an absolute value of the luminance difference, a polarity of the luminance difference, and a distance between the supplementary optical information and the reference gray level; and deciding the plurality of thresholds based on the plurality of gray level periods.

19. The method of claim 18, further comprising:

calculating a coefficient corresponding to each of the plurality of gray level periods based on the supplementary optical information; and storing the coefficient in the display driving circuit.

20. The method of claim 18, further comprising storing the reference look-up table or the plurality of thresholds in another display driving circuit configured to control a display panel different from the display panel.

* * * * *